US008358325B2

(12) United States Patent
Asai et al.

(10) Patent No.: US 8,358,325 B2
(45) Date of Patent: Jan. 22, 2013

(54) IMAGE PROCESSING METHOD, AND IMAGE PROCESSING APPARATUS

(75) Inventors: Toshiaki Asai, Shizuoka (JP); Yoshihiko Hotta, Shizuoka (JP); Tomomi Ishimi, Shizuoka (JP); Shinya Kawahara, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 162 days.

(21) Appl. No.: 12/900,930

(22) Filed: Oct. 8, 2010

(65) Prior Publication Data

US 2011/0090299 A1 Apr. 21, 2011

(30) Foreign Application Priority Data

Oct. 19, 2009 (JP) ..... 2009-240689

(51) Int. Cl.
*B41J 2/435* (2006.01)
*B41J 2/47* (2006.01)

(52) U.S. Cl. ..... 347/234; 347/248

(58) Field of Classification Search ..... 347/229, 347/234, 238, 248, 249
See application file for complete search history.

(56) References Cited

U.S. PATENT DOCUMENTS

| | | | |
|---|---|---|---|
| 7,422,996 | B2 | 9/2008 | Shimbo et al. |
| 7,439,993 | B2 | 10/2008 | Ishimi et al. |
| 7,728,860 | B2 | 6/2010 | Kawahara et al. |
| 2007/0225162 | A1 | 9/2007 | Kawahara et al. |
| 2008/0151033 | A1 | 6/2008 | Ishimi et al. |
| 2008/0153698 | A1 | 6/2008 | Kawahara et al. |
| 2008/0192618 | A1 | 8/2008 | Nakata et al. |
| 2008/0214391 | A1 | 9/2008 | Kawahara et al. |
| 2009/0075816 | A1 | 3/2009 | Kawahara et al. |
| 2009/0203521 | A1 | 8/2009 | Ishimi et al. |
| 2009/0244252 | A1 | 10/2009 | Kleckner et al. |
| 2010/0039916 | A1 | 2/2010 | Hasegawa et al. |
| 2010/0054106 | A1 | 3/2010 | Asai et al. |
| 2010/0061198 | A1 | 3/2010 | Kawahara et al. |
| 2010/0069238 | A1 | 3/2010 | Asai et al. |
| 2010/0069239 | A1 | 3/2010 | Asai et al. |
| 2010/0197492 | A1 | 8/2010 | Kawahara et al. |

FOREIGN PATENT DOCUMENTS

| | | |
|---|---|---|
| EP | 1834795 A1 | 9/2007 |
| EP | 1897695 A2 | 3/2008 |
| JP | 9-30118 | 2/1997 |
| JP | 11-151856 | 6/1999 |
| JP | 2000-136022 | 5/2000 |
| JP | 3161199 | 2/2001 |
| JP | 2004-265247 | 9/2004 |

(Continued)

OTHER PUBLICATIONS

Jan. 13, 2011 European search report in connection with counterpart European patent application No. 10 18 7931.

*Primary Examiner* — Hai C Pham
(74) *Attorney, Agent, or Firm* — Cooper & Dunham LLP

(57) ABSTRACT

The present invention provides an image processing method which includes recording an image by irradiating a recording medium with laser beams which are arrayed in parallel at predetermined intervals to heat the recording medium, so that the image is composed of a plurality of lines written with the laser beams on the recording medium, and wherein in the image recording, the plurality of lines written with the laser beams include a line written first and an overwritten line, a part of which is overlapped with the line written first; and the irradiation energy for the overwritten line is smaller than the irradiation energy for the line written first.

15 Claims, 12 Drawing Sheets

FOREIGN PATENT DOCUMENTS

| | | | |
|---|---|---|---|
| JP | 2004345273 A | * | 12/2004 |
| JP | 2006-255718 | | 9/2006 |
| JP | 3998193 | | 8/2007 |
| JP | 2008-62506 | | 3/2008 |
| JP | 4098937 | | 3/2008 |
| JP | 2008-213439 | | 9/2008 |

* cited by examiner

IMAGE PROCESSING METHOD, AND IMAGE PROCESSING APPARATUS

BACKGROUND OF THE INVENTION

1. Field of the Invention

The present invention relates to an image processing method and an image processing apparatus for forming an image having an arbitrary line width with a plurality of image lines.

2. Description of the Related Art

Image recording and image erasing on a thermoreversible recording medium have been carried out so far by a contact method in which a heating source is brought into contact with a recording medium to heat the thermoreversible recording medium. As the heating source, in the case of image recording, a thermal head is generally used, and in the case of image erasing, a heat roller, a ceramic heater or the like is generally used.

Such a contact image processing method has advantage in that, if a thermoreversible recording medium is a flexible material (e.g., a film, and paper sheet), an image can be uniformly recorded and erased by evenly pressing a heating source against a thermoreversible recording medium with use of a platen etc., and an image recording device and an image erasing device can be manufactured at low costs by using components of a conventional thermosensitive printer. However, when an RF-ID tag as disclosed in Japanese Patent Application Laid-Open (JP-A) No. 2004-265247 and Japanese Patent (JP-B) No. 3998193 is embedded in a thermoreversible recording medium, the thermoreversible recording medium needs to be thickened and the flexibility thereof degrades, and thus high pressure is required for uniformly pressing a heat source against the thermoreversible recording medium. In addition, in the contact image processing method, a surface of the thermoreversible recording medium is scraped due to repetitive printing and erasure and irregularities are formed therein, and some parts are not in contact with a heating source (e.g., thermal head, and hot stamp). Thus, the thermoreversible recording medium may not be uniformly heated, causing degradation in image density and erasing failure (see Japanese Patent (JP-B) No. 3161199 and Japanese Patent Application Laid-Open (JP-A) No. 09-30118).

In view of the fact that RF-ID tag enables reading and rewriting of memory information from some distance away from a thermoreversible recording medium in a non-contact manner, a demand arises for thermoreversible recording media as well. The demand is that an image be rewritten on such a thermoreversible recording medium from some distance away from the thermoreversible recording medium. To respond to the demand, a method using a laser is proposed as a method of forming and erasing each image on a thermoreversible recording medium from some distance away from the thermoreversible recording medium when there are irregularities on the surface thereof (see JP-A No. 2000-136022). It is the method by which non-contact recording is performed by using thermoreversible recording media on shipping containers used for physical distribution lines. Writing is performed by using a laser and erasing is performed by using a hot air, heated water, infrared heater, etc, but not by using a laser.

As such a recording method using a laser, a laser-recording device (laser maker) is proposed by which a thermoreversible recording medium is irradiated with a high-power laser light to control the irradiation position. A thermoreversible recording medium is irradiated with a laser light using the laser marker, and a photothermal conversion material in the thermoreversible recording medium absorbs light so as to convert it into heat, which can record and erase an image. An image recording and erasing method using a laser has been proposed, wherein a recording medium including a leuco dye, a reversible developer and various photothermal conversion materials in combination is used, and recording is performed thereon using a near infrared laser light (see JP-A No 11-151856).

However, in such a laser recording method, when an information-read code such as a two-dimensional code (e.g., character, bar code, and QR code) is recorded, but if an image having a predetermined line width is not precisely formed, the code may not be satisfactorily read through a machine, although the recorded image appears cleanly written visually. Also, when lines are written on a recording medium in an overlapped manner in an attempt to write a line having a width greater than the beam diameter of a laser beam used, the thermoreversible recording medium is excessively heated due to accumulation of heat, causing degradation in the repetitive durability of the thermoreversible recording medium.

JP-A No. 2008-213439 proposes a method for uniformly heating a recording medium, and JP-A No. 2008-62506 proposes a method for forming an image excellent in readability. However, the above methods have drawbacks in that it is impossible to precisely form an image having a predetermined line width, and the repetitive durability of recording media degrades.

As a printing method of two-dimensional codes, JP-A No. 2001-147985 proposes a method in which each cell is scanned in a spiral manner with a laser beam to print a code. In addition, JP-A No. 2006-255718 proposes a method in which the scanning position of a laser beam is corrected to obtain a predetermined line width. However, the above methods have a drawback in that the repetitive durability of recording media is poor, although it is possible to precisely form a predetermined line width.

When an image of two-dimensional codes (e.g., characters, bar codes, and QR codes) in various line thickness and various sizes is formed by laser marking, it is necessary to precisely form the image having a predetermined line width. Particularly in recording of bar codes, the recording accuracy influences the readability of the bar codes, and thus there is a need to precisely form various line widths. Further, when an image is formed on a rewritable thermoreversible recording medium and if an excessive amount of energy is applied thereto, the thermoreversible recording medium is physically damaged, causing degradation in the repetitive durability. Thus, to form an image having a predetermined line width, it is also required to uniformly apply energy to the thermoreversible recording medium.

Although the beam diameter of a laser beam irradiated to a thermoreversible recording medium is constant, the beam has a light intensity distribution, and thus the line width of an image can be changed by altering the irradiation power or the scanning speed of the laser beam so as to control the irradiation energy applied to the thermoreversible recording medium. However, when the irradiation energy is increased, unfavorably, the thermoreversible recording medium is physically damaged, causing degradation in repetitive durability, although the image is formed with a broader light width. On the other hand, when the irradiation energy is reduced to prevent degradation of the repetitive durability of the thermoreversible recording medium, the image is formed with a narrower line width, however, the contrast (density) of the formed lines decreases, causing degradation in image quality.

BRIEF SUMMARY OF THE INVENTION

The present invention aims to solve the above-mentioned conventional problems and to achieve the following object. That is, the object of the present invention is to provide an image processing method and an image processing apparatus which are capable of precisely forming a predetermined line width of an image and securing high repetitive durability.

Means for solving the above-mentioned problems are as follows:

<1> An image processing method including:

recording an image by irradiating a recording medium with laser beams which are arrayed in parallel at predetermined intervals to heat the recording medium, so that the image is composed of a plurality of lines written with the laser beams on the recording medium, wherein in the image recording, the plurality of lines written with the laser beams include a line written first and an overwritten line, a part of which is overlapped with the line written first; and the irradiation energy for the overwritten line is smaller than the irradiation energy for the line written first.

<2> The image processing method according to <1> above, wherein a ratio X of an overlapped width of the overwritten line relative to a line width of the line written first, and a ratio Y of the irradiation energy for the line written first relative to the irradiation energy applied to the overwritten line satisfy the following Expression (1):

$$0.6 \leqq 0.8X+Y \leqq 1.0 \quad \text{Expression (1)}$$

<3> The image processing method according to <2> above, wherein the ratio X satisfies the following Expression (2):

$$0.7 \leqq -0.8X+Y \leqq 1.0 \quad \text{Expression (2)}$$

<4> The image processing method according to <2> above, wherein the ratio X satisfies the following Expression (3):

$$0.4 \leqq X < 1 \quad \text{Expression (3)}$$

<5> The image processing method according to <2> above, wherein the ratio X satisfies the following Expression (4):

$$0.6 \leqq X < 1 \quad \text{Expression (4)}$$

<6> The image processing method according to any one of <1> to <5> above, wherein the irradiation energy for the lines written with the laser beams is controlled by adjusting irradiation power of the laser beam.

<7> The image processing method according to any one of <1> to <6> above, wherein the irradiation energy for the lines written with the laser beams is controlled by adjusting the scanning speed of the laser beam.

<8> The image processing method according to any one of <1> to <7> above, wherein in a light intensity distribution on a cross-sectional plane along a direction substantially orthogonal to a traveling direction of the laser beams irradiated in the image recording, the intensity of a light beam applied onto a central portion is equal to or lower than the intensity of a light beam applied onto peripheral portions.

<9> The image processing method according to any one of <1> to <8> above, wherein the recording medium is a thermoreversible recording medium, the thermoreversible recording medium includes a support and at least a first thermoreversible recording layer, a photothermal conversion layer containing a photothermal conversion material which absorbs light having a specific wavelength and converts the light into heat, and a second thermoreversible recording layer in this order over the support; and both the first thermoreversible recording layer and the second thermoreversible recording layer reversibly change in color tone depending on a change in temperature.

<10> The image processing method according to any one of <1> to <8> above, wherein the recording medium is a thermoreversible recording medium, the thermoreversible recording medium includes a support and at least a thermoreversible recording layer containing a photothermal conversion material, which absorbs light having a specific wavelength and converts the light into heat, a leuco dye and a reversible developer, over the support; and the thermoreversible recording layer reversibly changes in color tone depending on a change in temperature.

<11> The image processing method according to <9> above, wherein the first thermoreversible recording layer and the second thermoreversible recording layer individually contains a leuco dye and a reversible developer.

<12> The image processing method according to any one of <9> to <11> above, wherein the photothermal conversion material is a material having an absorption peak in the near-infrared spectral region.

<13> The image processing method according to any one of <9> to <12> above, wherein the photothermal conversion material is one of a metal boride and a metal oxide.

<14> The image processing method according to any one of <9> to <12> above, wherein the photothermal conversion material is a phthalocyanine-based compound.

<15> An image processing apparatus including:

a laser beam emitting unit, an optical scanning unit disposed on a laser-beam emitting surface of the laser beam emitting unit, a light-irradiation-intensity-distribution-adjusting unit configured to alter a light irradiation intensity distribution of a laser beam, and an fθ lens which converges laser beams, wherein the image processing apparatus is used for the image processing method according to any one of <1> to <14> above.

<16> The image processing apparatus according to <15> above, wherein the light-irradiation-intensity-distribution-adjusting unit is at least one selected from the group consisting of a lens, a filter, a mask, a mirror, and a fiber coupling.

The present invention can solve the above-mentioned problems, achieve the object and provide an image processing method and image processing apparatus which enable precisely forming an image of lines having a predetermined line width and ensuring repetitive durability.

DETAILED DESCRIPTION OF THE INVENTION

Image Processing Method

An image processing method according to the present invention includes at least an image erasing step and further includes other steps suitably selected in accordance with the intended use.

Here, in the present invention, the term "an image" means a line (lines) having a predetermined line width formed with a line (lines) written by a plurality of laser beams, and includes lines constituting a two-dimensional code (e.g., bar code, and QR code), or bold characters.

Figure 8:
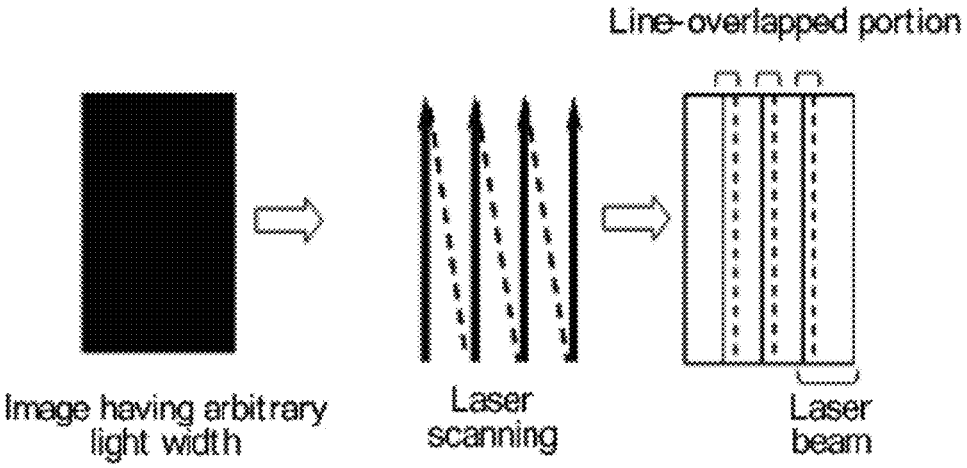
FIG. 8 is a diagram illustrating an overlapped portion of an image in the present invention.
Figure 9:
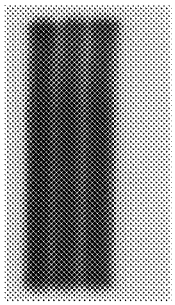
FIG. 9 is a photograph illustrating print dropout.

Also, in the present invention, the term "an overlapped portion" means a portion in which a plurality of lines written with laser beams are overlapped with each other. For example, when a line having a predetermined line width is recorded, a line written by laser beam needs to be overlapped with another line written by laser beam adjacent to the former line, as illustrated in FIG. 8. When there is no overlapped portion, print dropout as illustrated in FIG. 9 may occur. By forming the plurality of lines written by laser beams in an overlapped manner, an image having a predetermined line width can be formed. The number of lines written by laser beams may be suitably selected in accordance with the intended use without any restriction.

The image processing method of the present invention is not particularly limited and may be suitably selected in accordance with the intended use. For instance, the image processing method may also be used on irreversible recording media, however, is preferably used as an image processing method in which an image is formed and erased on a thermoreversible recording medium In this case, the image processing method includes the image processing method of the present invention as an image recording step and further includes an image erasing step for erasing the image formed in the image recording step. Hereinbelow, the image processing method of the present invention may be referred to as "image recording step".

<Image Recording Step>

In the image processing method of the present invention, the image recording step is a step of recording an image by heating a thermoreversible recording medium through irradiation with laser beams.

In the present invention, an image is recorded by heating a thermoreversible recording medium through irradiation with laser beams, which are arrayed in parallel at predetermined intervals, while sequentially scanning the thermoreversible recording medium with the laser beams.

The laser-beam scanning method may be suitably selected in accordance with the intended use without any restriction. Examples thereof include laser scanning as illustrated in FIG. 8.

The scanning of laser beams may be performed in the same direction or in an opposite direction, and discontinuous irradiation may be included in part of the scanning.

Figure 1A:
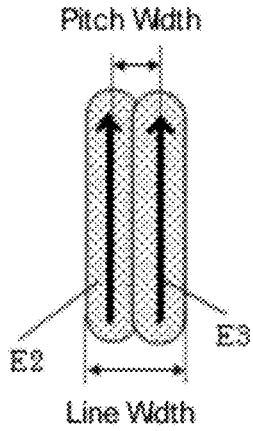
FIG. 1A is a diagram illustrating an image processing method according to the present invention (first).

For example, as illustrated in FIG. 1A, an image having a predetermined line width is recorded in the manner where two lines E2 and E3 written with laser beam are made to scan sequentially in the order of E2 and E3 at a predetermined pitch width, in the direction indicated by an arrow in the figure so that the first line written with laser beam (which may be otherwise referred to as "first written line" or "line written first") E2 and the second line written with laser beam (which may be otherwise referred to as "second written line") E3 are partially overlapped with each other.

Of the lines E2 and E3, the line E2 is a first written line, and the line E3 is an overwritten line.

Figure 1B:
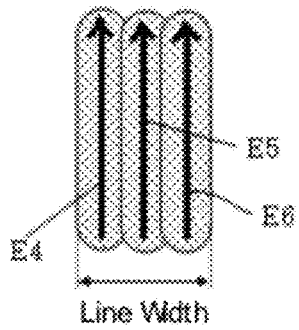
FIG. 1B is a diagram illustrating an image processing method according to the present invention (second).

In addition, for example, as illustrated in FIG. 1B, three lines E4, E5 and E6 each written with laser beam are formed in the manner where a first line written with laser beam (first written line) E4 and a second line written with laser beam (second written line) E5 are partially overlapped with each other, and the second written line E5 and a third line written with laser beam (which may be otherwise referred to as "third written line") E6 are partially overlapped with each other, at a predetermined pitch while sequentially scanning with laser beams in the order of E4, E5 and E6, in a direction indicated by an arrow in the figure, thereby recording a line image having a predetermined line width.

Among these three written lines E4, E5 and E6, the line E4 is a first written line, and the lines E5 and E6 are overwritten lines.

Figure 1C:
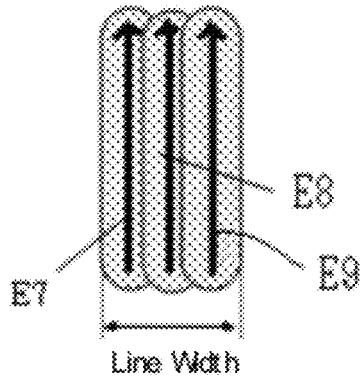
FIG. 1C is a diagram illustrating an image processing method according to the present invention (third).

Further, as illustrate in FIG. 1C, three lines E7, E8 and E9 written with laser beam are formed in the manner where a first line written with laser beam (first written line) E7 and a second line written with laser beam (second written line) E8 are partially overlapped with each other, and the second line E8 and a third line written with laser beam (third written line) E9 are partially overlapped with each other, at a predetermined pitch while sequentially scanning with laser beams in the order of E7, E8 and E9, in a direction indicated by an arrow in the figure, thereby recording a line image having a predetermined line width.

Among these three lines E7, E8 and E9, the line E7 is a first written line, and the lines E8 and E9 are overwritten lines.

In the image processing method of the present invention, overwritten lines are recorded with an irradiation energy smaller than the irradiation energy for the line written first.

Here, the overlapped width in the image processing method illustrated in FIG. 1C is greater than that in the image processing method illustrated in FIG. 1B, and thus in the image processing method illustrated in FIG. 1C, the amount of irradiation energy for the overwritten lines E8 and E9 relative to the irradiation energy for the first written line E7 should be reduced much more than in the image processing method illustrated in FIG. 1B.

The region of the line written first has low heat accumulation and a little overlapped portion, and thus in order to prevent a reduction in image density, it is necessary to apply a sufficient amount of irradiation energy to the region.

Meanwhile, the region of the overwritten lines has high heat accumulation and a large portion overlapped with other written portions, and thus in order to improve the repetitive durability, the irradiation energy for the overwritten lines should be reduced much more than the irradiation energy for the line written first.

When there is a plurality of overwritten lines, the irradiation energy for the overwritten lines may be suitably adjusted in accordance with the intended use without any restriction, however, it is preferable to use the same irradiation energy in the light of uniformity of image density, precision of the line width and repetitive durability.

Figure 2:
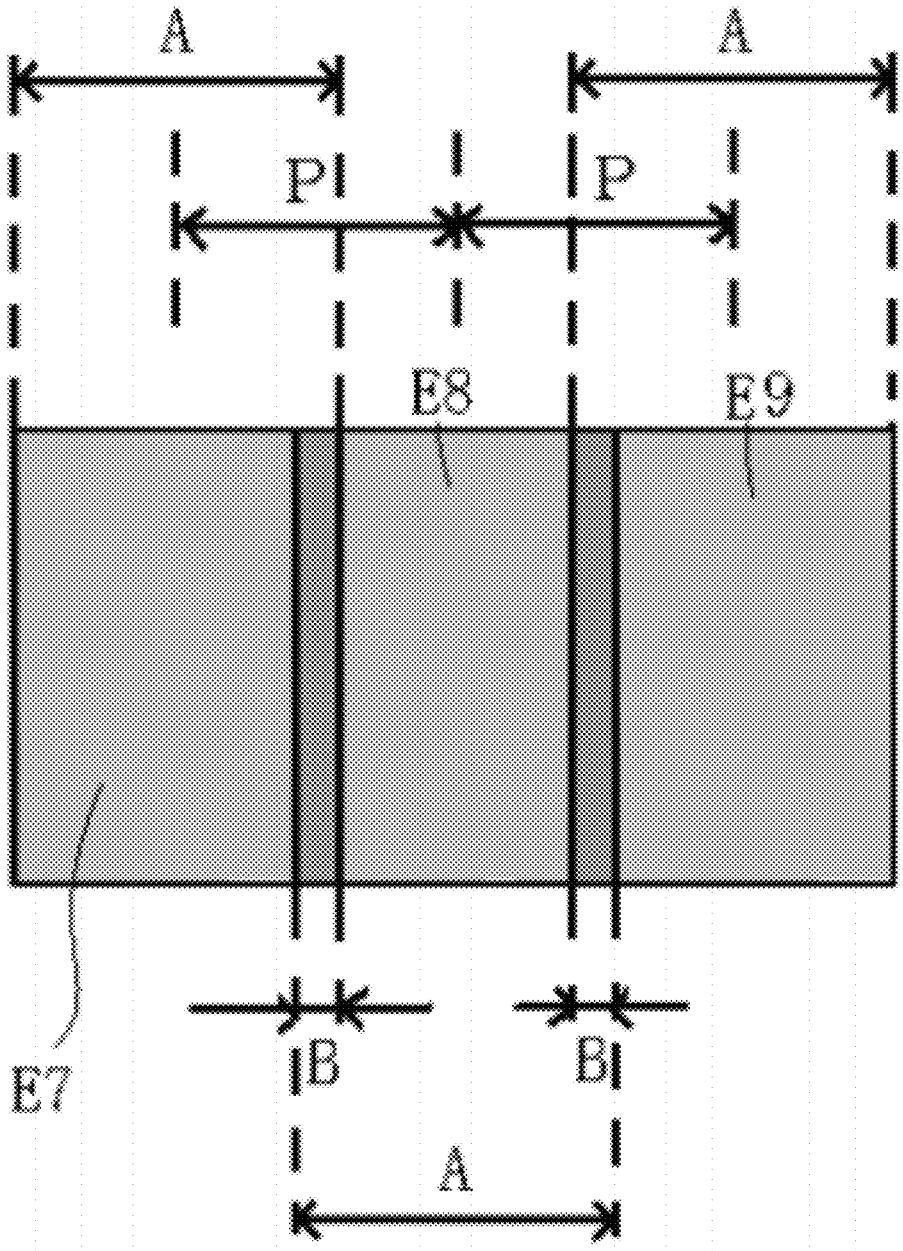
FIG. 2 is a diagram illustrating an image processing method according to the present invention (fourth).

More specifically, as illustrated in FIG. 2, a ratio X (overlapped width B/line width A) of an overlapped width B (mm) of overwritten lines relative to a line width A (mm) of the line written first and a ratio Y (irradiation energy for line E7/irradiation energy for overwritten lines E8 and E9) of an irradiation energy for the line written first E7 relative to an irradiation energy for the overwritten lines E8 and E9 preferably satisfy the following Relationship (1), and more preferably satisfy the following Relationship (2).

$$0.6 \leqq -0.8X+Y \leqq 1.0 \quad \text{Relationship (1)}$$

$$0.7 \leqq -0.8X+Y \leqq 1.0 \quad \text{Relationship (2)}$$

Here, in the case of $-0.8X+Y<0.6$, that is, when the irradiation energy for the overwritten lines E8 and E9 is not sufficiently reduced relative to the irradiation energy for the line written first E7, an excessively high energy is applied to the overlapped portion of the line image written with laser beams, the recording medium suffers from damage, and the durability or the recording medium may degrade. In contrast, in the case of $-0.8X+Y>1.0$, that is, when the irradiation energy for the overwritten lines E8 and E9 is insufficient, the image quality may degrade.

Note that in FIG. 2, P denotes a pitch width, which is represented by a difference between the line width A and the overlapped width B.

In addition, the ratio X (overlapped width B/line width A) of an overlapped width B (mm) of the overwritten line with respect to a line width A (mm) of the line written first may be suitably selected in accordance with the intended use without any restriction. However, the ratio X preferably satisfies the following Relationship (3), and more preferably satisfies the following Relationship (4).

$$0.4 \leqq X < 1 \quad \text{Relationship (3)}$$

$$0.6 \leqq X < 1 \quad \text{Relationship (4)}$$

When X is 0.4 or less, image dropout and image feathering may occur even if the irradiation energy for the overwritten lines is reduced to that of the line written first. In contrast, when X is within a range more preferable than those represented by Relationships (2) and (3), it is advantageous in that the repetitive durability can be further improvised.

The output power of the laser beam irradiated in the image recording step may be suitably selected in accordance with the intended use without any restriction. It is, however, preferably 1 W or higher, more preferably 3 W or higher, and particularly preferably 5 W or higher. When the output power is lower than 1 W, it takes time to form an image, and if an attempt is made to shorten the image recording time, the output power becomes insufficient.

The upper limit of the output power of laser beams may be suitably selected in accordance with the intended use without any restriction. It is, however, preferably 200 W or lower, more preferably 150 W or lower, and particularly preferably 100 W or lower. When the upper limit is higher than 200 W, the laser device may become larger in size.

The scanning speed of the laser beams irradiated in the image recording step may be suitably selected in accordance with the intended use without any restriction. It is, however, preferably 300 mm/s or higher, more preferably 500 mm/s or higher, and particularly preferably 700 mm/s or higher. When the scanning speed is lower than 300 mm/s, it takes time to form an image.

Also, the upper limit of the scanning speed of the laser beams may be suitably selected in accordance with the intended use without any restrictions. It is, however, preferably 15,000 mm/s or lower, more preferably 10,000 mm/s or lower, and particularly preferably 8,000 mm/s or lower. When the upper limit is higher than 15,000 mm/s, it becomes difficult to form an image uniformly.

The spot diameter of the laser beams irradiated in the image recording step may be suitably selected in accordance with the intended use without any restriction. It is, however, preferably 0.02 mm or greater, more preferably 0.1 mm or greater, and particularly preferably 0.15 mm or greater. When the spot diameter is smaller than 0.02 mm, the line width of the resulting line image decreases, and the visibility degrades.

The upper limit of the spot diameter of the laser beams may be suitably selected in accordance with the intended use without any restriction. It is, however, preferably 3.0 mm or smaller, more preferably 2.5 mm or smaller, and particularly preferably 2.0 mm or smaller. When the spot diameter is greater than 3.0 mm, the line width of the resulting line image increases, adjacent lines are overlapped, and it becomes impossible to form small-size images.

The source of the laser beams is not particularly limited, however, it is preferably at least one selected from a semiconductor laser beam, a solid laser beam, a fiber laser beam, and a $CO_2$ laser beam.

The method of controlling the line width of an image to be formed may be suitably selected in accordance with the intended use without any restriction. For example, controlling the number of lines to be written, and controlling an overlapped width (pitch width) are exemplified.

<Image Erasing Step>

The image erasing step is a step of erasing an image recorded on a recording medium by the image processing method, by heating the recording medium.

The recording medium is not particularly limited, and may be suitably selected in accordance with the intended use. Examples thereof include thermoreversible recording media, and non-reversible recording media. Among these, thermoreversible recording media are particularly preferable.

The method of heating the thermoreversible recording medium is not particularly limited, and examples there of include conventionally known heating methods (non-contact heating method such as irradiation with a laser beam, hot air, warm water, infrared ray heater; and contact heating methods such as thermal head, hot stamp, heat block, heat roller). When assuming a physical distribution line, the method of heating a thermoreversible recording medium through irradiation with a laser beam is preferred in that the formed image can be erased in noncontact with the thermoreversible recording medium.

The output power of the leaser beams irradiated to the thermoreversible recording medium in the image erasing step may be suitably selected in accordance with the intended use without any restriction. It is, however, preferably 5 W or higher, more preferably 7 W or higher, and particularly preferably 10 W or higher. When the output power is lower than 5 W, it takes time to erase an image, and if an attempt is made to shorten the image recording time, the output power becomes insufficient, causing image erasing failure.

The upper limit of the output power of the laser beams may be suitably adjusted in accordance with the intended use without any restriction. It is, however, preferably 200 W or lower, more preferably 150 W or lower, and particularly preferably 100 W or lower. When the output power is higher than 200 W, the laser device may become larger in size.

The scanning speed of the laser beams irradiated to the thermoreversible recording medium in the image recording step may be suitably selected in accordance with the intended use without any restriction. It is, however, preferably 100 mm/s or higher, more preferably 200 mm/s or higher, and particularly preferably 300 mm/s or higher. When the scanning speed is lower than 100 mm/s, it takes time to erase the formed image.

Also, the upper limit of the scanning speed of the laser beams may be suitably selected in accordance with the intended use without any restrictions. It is, however, preferably 20,000 mm/s or lower, more preferably 15,000 mm/s or lower, and particularly preferably 10,000 mm/s or lower. When the upper limit is higher than 20,000 mm/s, it becomes difficult to erase the formed image uniformly.

The source of the laser beams irradiated in the image erasing step is not particularly limited, however, it is preferably at least one selected from a semiconductor laser beam, a solid laser beam, a fiber laser beam, and a $CO_2$ laser beam.

The spot diameter of the laser beams irradiated to the thermoreversible recording medium in the image erasing step may be suitably selected in accordance with the intended use without any restriction. It is, however, preferably 0.5 mm or greater, more preferably 1.0 mm or greater, and particularly preferably 2.0 mm or greater. When the spot diameter is smaller than 0.5 mm, it takes time to erase the formed image.

The upper limit of the spot diameter of the laser beams may be suitably selected in accordance with the intended use without any restriction. It is, however, preferably 14.0 mm or smaller, more preferably 10.0 mm or smaller, and particularly preferably 7.0 mm or smaller. When the spot diameter is greater than 14.0 mm, the output power becomes insufficient, causing image erasing failure.

The method of controlling the irradiation energy of the lines written with laser beams may be suitably selected in accordance with the intended use without any restriction. For example, controlling the irradiation power of laser beams, and controlling the scanning speed of laser beams are exemplified.

In the present invention, the scanning of laser beams can be controlled depending on a combination of motion of a mirror serving as a scanning controlling unit provided in the image processing apparatus, movement of a thermoreversible recording medium or the image processing apparatus, and other factors. The controlling of the scanning of laser beams may be freely designed without deviating from the spirit and scope of the present invention.

In a light intensity distribution on a cross-sectional plane along a direction substantially orthogonal to a traveling direction of the laser beams irradiated (which may be otherwise referred to as "orthogonal plane to the laser beam-traveling direction") in the image recording step and the image erasing step, the laser beams are preferably irradiated to the thermoreversible recording medium so that the intensity of a light beam applied onto a central portion is equal to or lower than the intensity of a light beam applied onto peripheral portions.

Conventionally, when a certain pattern is formed using a laser, the light intensity distribution on an orthogonal plane to the laser beam-traveling direction shows a Gaussian distribution, and the light irradiation intensity of the center portion irradiated with the laser beam is extremely high as compared with the light irradiation intensity of peripheral portions. When this laser beam having a Gaussian distribution is irradiated to the thermoreversible recording medium, the temperature of the center portion is excessively increased, and when image recording and image erasure are repeatedly carried out, the thermoreversible recording medium corresponding to the center portion deteriorates, there is a need to decrease the number of repeated image processing times. When the irradiation energy is reduced so as not to increase the temperature of the center portion to a temperature at which the thermoreversible recording medium deteriorates, there are problems that a formed image is decreased in size, the image contrast decreases, and it takes time to record an image.

Then, in a light intensity distribution on a cross-sectional plane along a direction orthogonal to a traveling direction of the laser beams irradiated in the image recording step and the image erasing step, by controlling the light irradiation intensity of a light beam applied to the center portion so as to be equal to or lower than the light irradiation intensity of a laser beam applied to the peripheral portions, an improvement of the repetitive durability of the thermoreversible recording medium can be achieved while preventing the thermoreversible recording medium from deteriorating due to repeated image recording and image erasure operations and maintaining high image contrast, without reducing the size of the formed image.

[Center Portion and Peripheral Portion in Light Intensity Distribution]

The "center portion" in the light intensity distribution on a cross-sectional plane along a direction substantially orthogonal to a traveling direction of the laser beams means a region corresponding to the region sandwiched by peak top portions of two maximum peaks of convexes protruding downward in a differential curve which is obtained by differentiating twice with respect to the curve representing the light intensity distribution, and the "peripheral portions" means regions corresponding to regions excluding the "center portion".

The "light irradiation intensity of the center portion", if the light intensity distribution in the center portion is represented with a curve, means its peak top portion and a light irradiation intensity in the peak top portion in the case where the light intensity distribution curve is in the form of a convex protruding upward, but in the case where the light intensity distribution curve is in the form of a convex protruding downward, the "light irradiation intensity" means a light irradiating intensity in the peak bottom portion. Further, when the light intensity distribution curve has both the convex protruding upward and the convex protruding downward, the light irradiation intensity of the center portion means a light irradiation intensity of a peak top portion positioned at a region near the center in the center portion.

Furthermore, when the light intensity distribution of the center portion is represented by a straight line, it means a light irradiation intensity at the highest portion of the straight line, however, in this case, in the center portion, the light irradiation intensity preferably constant (the light irradiation intensity in the center portion is represented by a horizontal line).

Meanwhile, in the case where the light intensity distribution of the peripheral portions" is represented by one of a curve and a straight line, the "light irradiation intensity of the peripheral portions" also means a light irradiation intensity Hereinbelow, examples of the light irradiation intensities of a "center portion" and "peripheral portions" in a light intensity distribution on the orthogonal plane to the laser beam-traveling direction are illustrated in FIGS. 3A to 3E. Note that in FIGS. 3A to 3E, a curve representing a light intensity distribution, a differential curve (X') which is obtained by differentiating once with respect to a curve representing the light intensity distribution, and a differential curve (X") which is obtained by differentiating twice with respect to the curve representing the light intensity distribution are illustrated from the top.

FIGS. 3A to 3D illustrates light intensity distributions of laser beam used in the image processing method of the present invention, in which the light irradiation intensity of the center portion is equal to or lower than the light irradiation intensity of the peripheral portions.

Figure 3A:
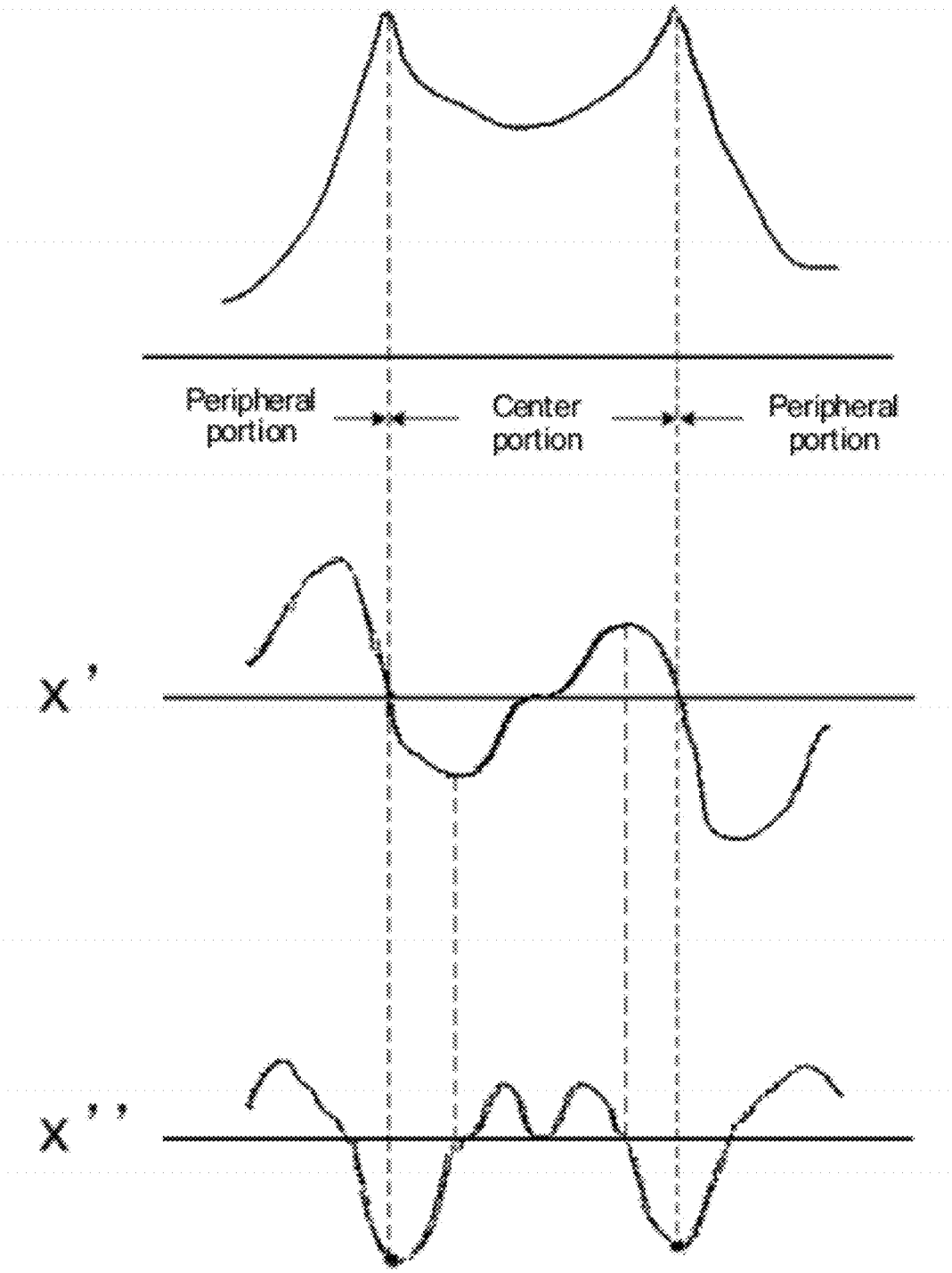
FIG. 3A is a schematic diagram illustrating one example of intensities of light-irradiation at "a central portion" and "peripheral portions" in a light intensity distribution on a cross-sectional plane along a direction orthogonal to the traveling direction of a laser beam used in an image processing method according to the present invention.
Figure 3B:
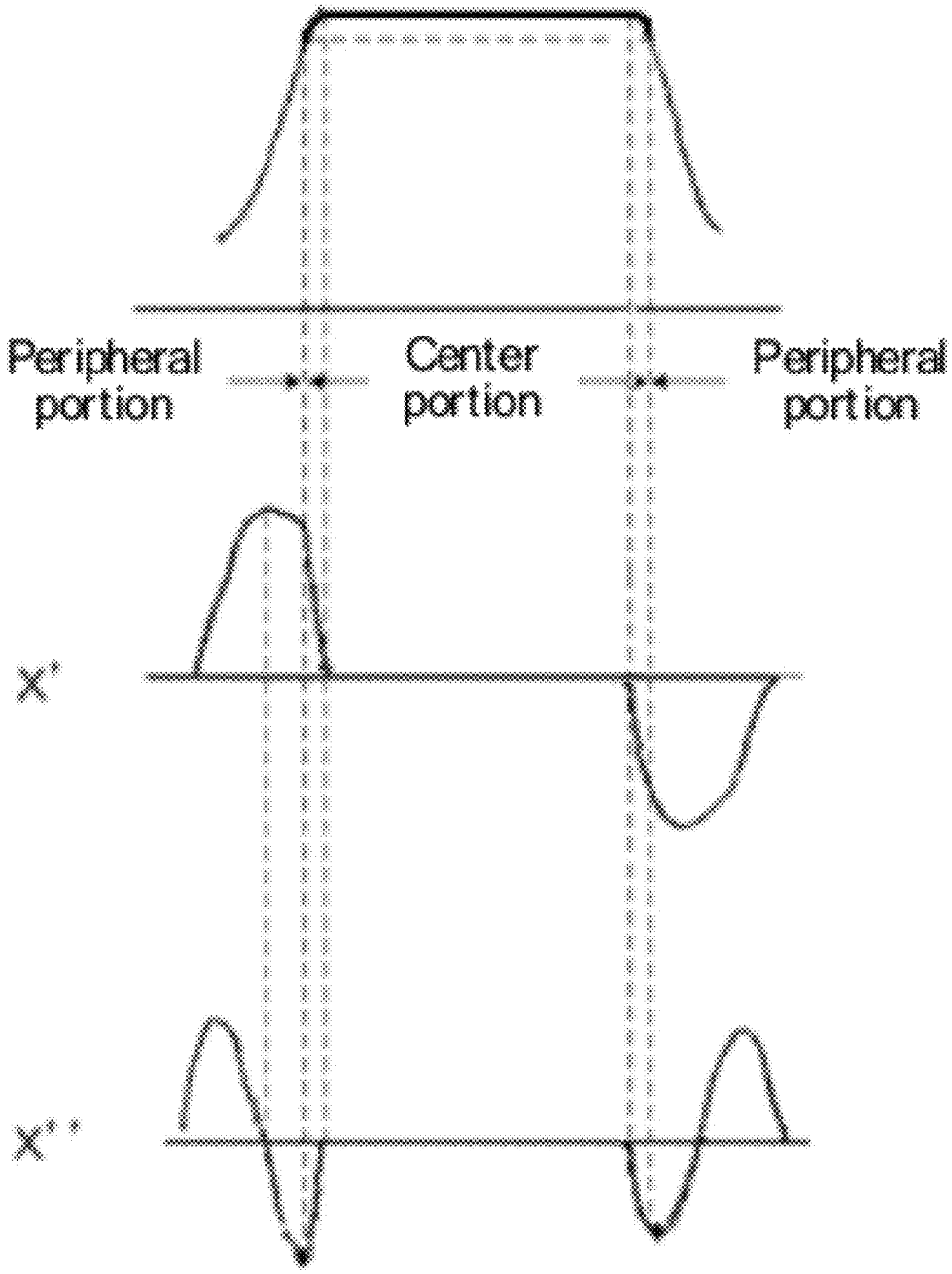
FIG. 3B is a schematic diagram illustrating another example of intensities of light-irradiation at "a central portion" and "peripheral portions" in a light intensity distribution on a cross-sectional plane orthogonal to the traveling direction of a laser beam used in an image processing method according to the present invention.
Figure 3C:
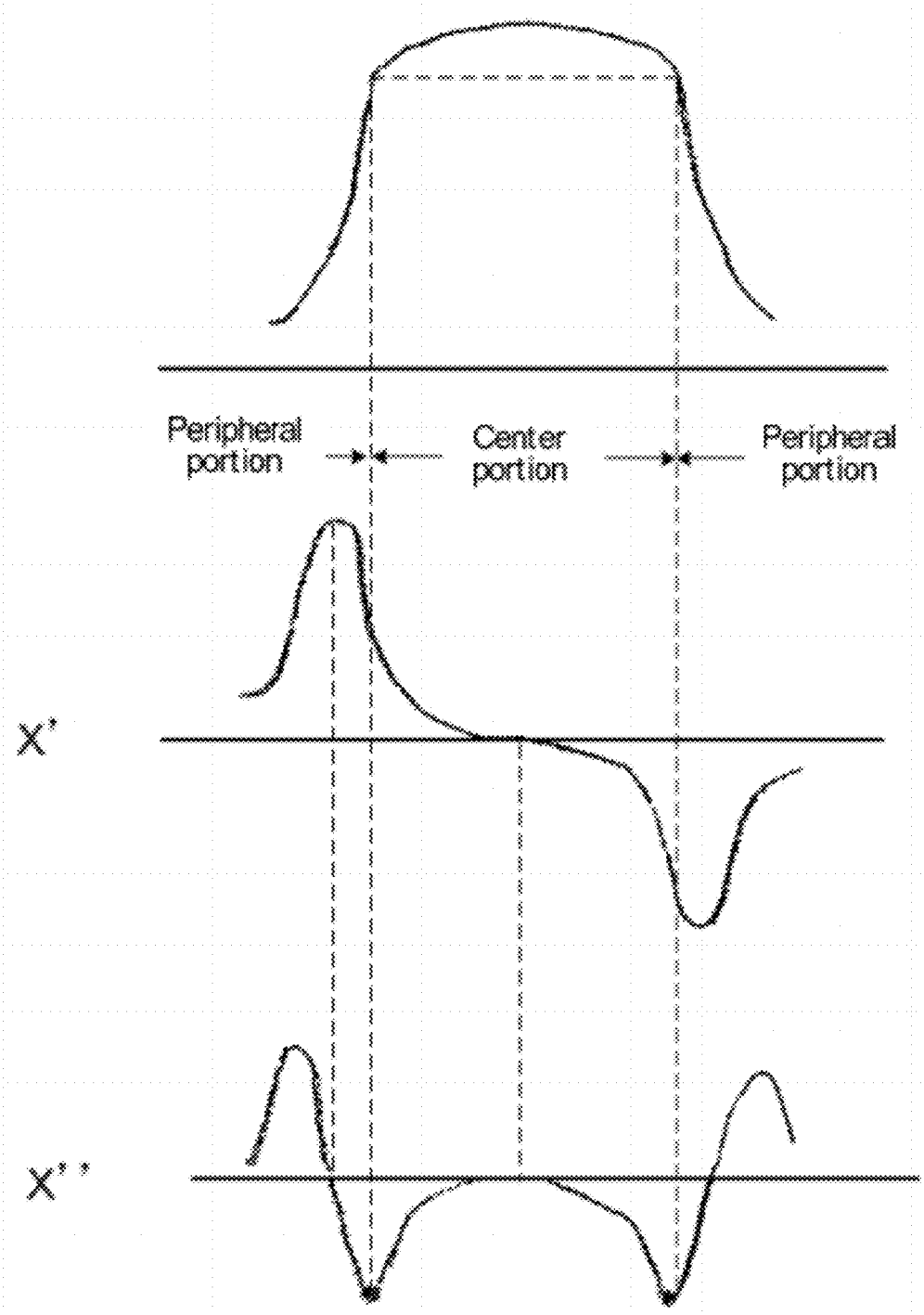
FIG. 3C is a schematic diagram illustrating still another example of intensities of light-irradiation at "a central portion" and "peripheral portions" in a light intensity distribution on a cross-sectional plane orthogonal to the traveling direction of a laser beam used in an image processing method according to the present invention.
Figure 3D:
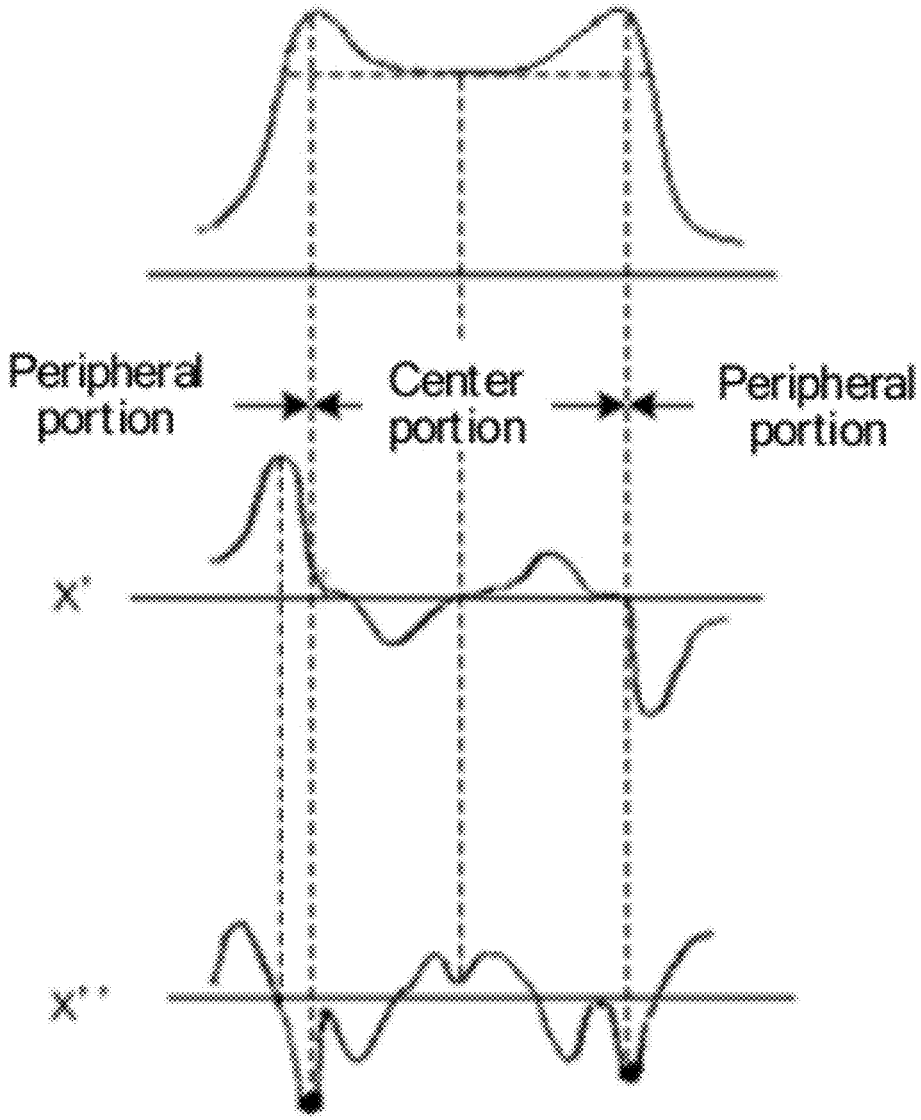
FIG. 3D is a schematic diagram illustrating yet still another example of intensities of light-irradiation at "a central portion" and "peripheral portions" in a light intensity distribution on a cross-sectional plane orthogonal to the traveling direction of a laser beam used in an image processing method according to the present invention.
Figure 3E:
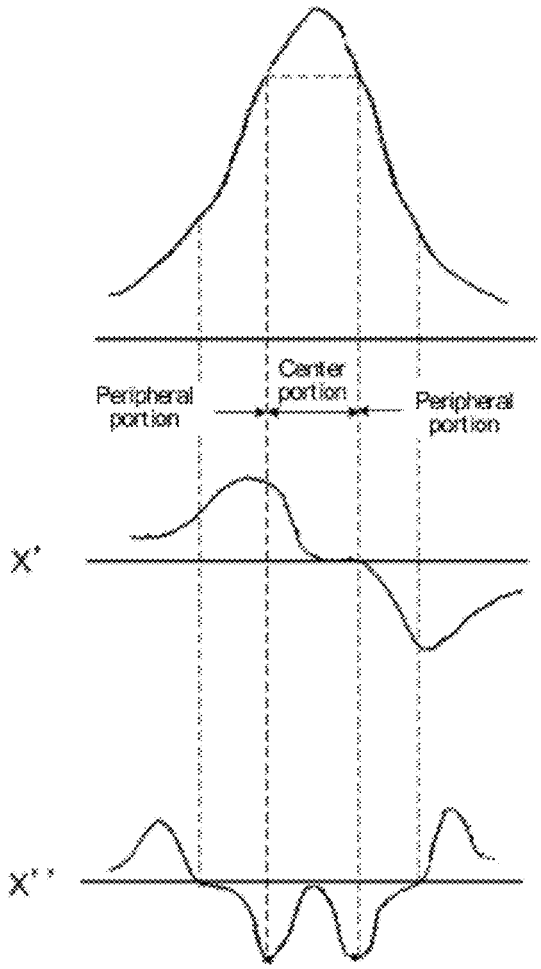
FIG. 3E is a schematic diagram illustrating intensities of light-irradiation at "a central portion" and "peripheral portions" in a light intensity distribution (Gaussian distribution) on a cross-sectional plane orthogonal to the traveling direction of a typical laser beam.

Meanwhile, FIG. 3E illustrates a light intensity distribution of a common laser beam, and the light intensity distribution shows a Gaussian distribution, in which the light irradiation intensity of the center portion is excessively high as compared with the light irradiation intensity of the peripheral portions.

In the light intensity distribution on the orthogonal plane to the laser beam-traveling direction, as the relationship of light irradiation intensities between the center portion and the peripheral portions, the light irradiation intensity of the center portions is required to be equal to or lower than the light irradiation intensity of the peripheral portions. The wording "equal to or lower than" means that the light irradiation intensity of the center portion is 1.05 times or less, preferably 1.03 times or less, and particularly preferably 1.0 time the light irradiation intensity of the peripheral portions. The light irradiation intensity of the center portion is smaller than that of the peripheral portions, that is, particularly preferably less than 1.0 time the light irradiation intensity of the peripheral portions.

When the light irradiation intensity of the center portion is 1.05 times or less the light irradiation intensity of the peripheral portions, it is possible to prevent deterioration of the thermoreversible recording medium due to an increase in temperature at the center portions.

Meanwhile, the lower limit of the light irradiation intensity of the center portion may be suitably selected in accordance with the intended use without any restriction. It is, however, preferably 0.1 times or more, and more preferably 0.3 times or more the light irradiation intensity of the peripheral portions.

When the light irradiation intensity of the center portion is less than 0.1 times the light irradiation intensity of the peripheral portions, the temperature of the thermoreversible recording medium, at the irradiation spot of the laser beams is not sufficiently increased, the image density corresponding to the center portion may be decreased as compared with the image density corresponding to the peripheral portions, and the formed image may not be satisfactorily erased.

As the method of measuring the light intensity distribution on the orthogonal plane to the laser beam-traveling direction, if the laser beam is emitted from, for example, a semiconductor laser, an YAG laser or the like, and has a wavelength in a near-infrared region, the light intensity distribution can be measured by a laser beam profiler using a CCD etc. Additionally, if the laser beam is emitted from, for example, a $CO_2$ laser and has a wavelength in a far-infrared region, the CCD cannot be used, and thus the light intensity distribution can be measured by a combination of a beam splitter and a power meter, a high-power beam analyzer using a high-sensitive pyroelectric camera.

The method of converting the light intensity distribution on the orthogonal plane to the laser beam-traveling direction from the Gaussian distribution into a light intensity distribution where the light irradiation intensity of the center portion is equal to or lower than the light irradiation intensity of the peripheral portions may be suitably selected in accordance with the intended use without any restriction, however, a light-irradiation-intensity-distribution-adjusting unit can be suitably used.

Preferred examples of the light-irradiation-intensity-distribution-adjusting unit include a lens, a filter, a mask, and a mirror. More specifically, for example, a collide scope, an integrator, a beam-homogenizer, an aspheric beam-shaper (a combination of an intensity conversion lens and a phase correction lens) can be preferably used. In addition, the light irradiation intensity can also be controlled by physically cutting a center portion of the laser beam using a filter, a mask, or the like. When a mirror is used, the light irradiation intensity can be adjusted by using a deformable mirror capable of interfacing with a computer to mechanically deform light beams, mirrors each having a different reflectance or partially different surface irregularities, or the like.

Also, the light irradiation intensity can also be controlled by shifting the distance between the thermoreversible recording medium and the lens from the focal point distance, and further by fiber-coupling a semiconductor laser, an YAG laser or the like, the light irradiation intensity can be easily controlled.

The method of controlling the light irradiation intensity using the light-irradiation-intensity-distribution-adjusting unit will be described through the after-mentioned description on the image processing apparatus of the present invention.

<Thermoreversible Recording Medium>

The thermoreversible recording medium may be suitably selected in accordance with the intended use without any restriction. The thermoreversible recording medium preferably includes a support, a first thermoreversible recording layer, a photothermal conversion layer, and a second thermoreversible recording layer in this order over the support, and further includes other layers suitably selected as required such as a first oxygen barrier layer, a second oxygen barrier layer, an ultraviolet absorbing layer, a back layer, a protective layer, an intermediate layer, an undercoat layer, an adhesive layer, a tackiness layer, a colored layer, an air layer, and a light reflective layer.

Each of these layers may be formed in a single layer structure or a multi-layered structure, provided that as for layers which are provided over the photothermal conversion layer, in order to reduce energy loss of a laser beam with a specific wavelength irradiated, each of them preferably formed of a material of less absorbing light of the specific wavelength.

Figure 10A:
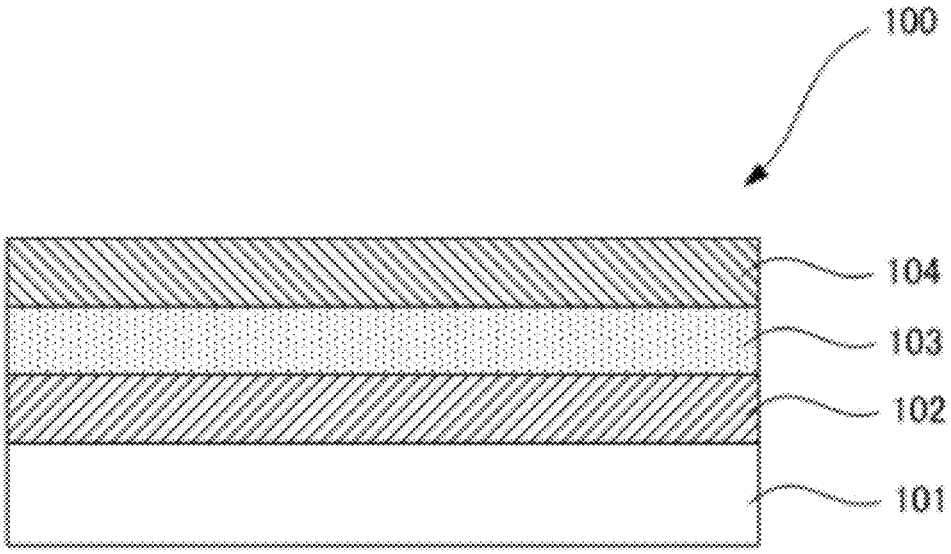
FIG. 10A is a schematic cross-sectional diagram illustrating one example of a layer configuration of a thermoreversible recording medium according to the present invention.

Here, the layer configuration of a thermoreversible recording medium 100 is not particularly limited, for example, as illustrated in FIG. 10A, an aspect of the layer configuration is exemplified in which the thermoreversible recording medium 100 has a support 101, and a first thermoreversible recording layer 102, a photothermal conversion layer 103, and a second thermoreversible recording layer 104 in this order over the support 101.

Figure 10B:
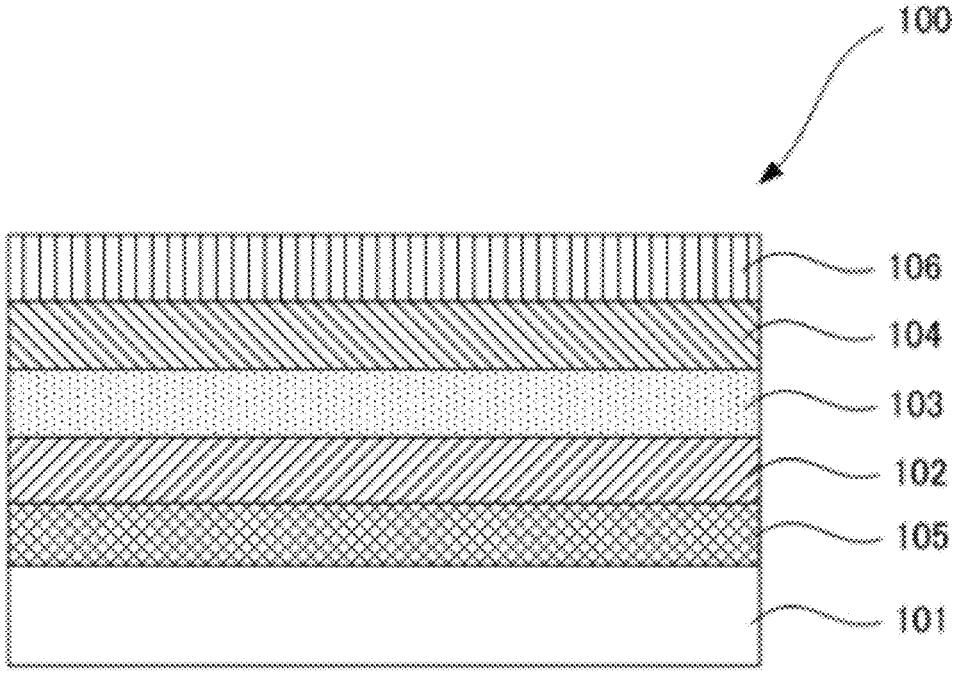
FIG. 10B is a schematic cross-sectional diagram illustrating another example of a layer configuration of a thermoreversible recording medium according to the present invention.

Further, as illustrated in FIG. 10B, an aspect of the layer configuration is exemplified in which a thermoreversible recording medium 100 has a support 101, a first oxygen barrier layer 105, a first thermoreversible recording layer 102, a photothermal conversion layer 103, a second thermoreversible recording layer 104, and a second oxygen barrier layer 106 in this order over the support 101.

Figure 10C:
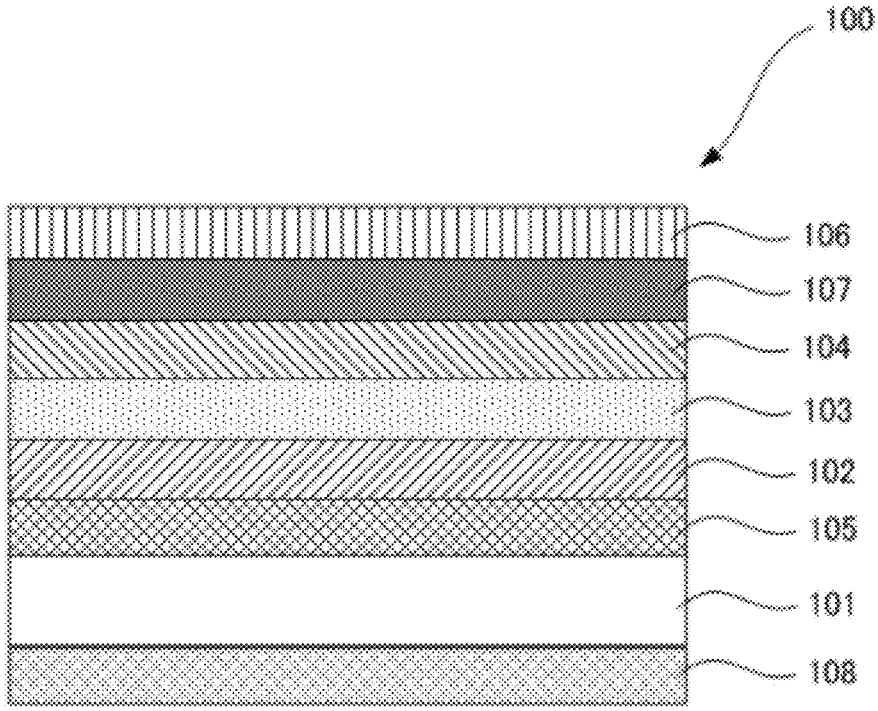
FIG. 10C is a schematic cross-sectional diagram illustrating yet another example of a layer configuration of a thermoreversible recording medium according to the present invention.

Furthermore, as illustrated in FIG. 10C, an aspect of the layer configuration is exemplified in which a thermoreversible recording medium 100 has a support 101, a first oxygen barrier layer 105, a first thermoreversible recording layer 102, a photothermal conversion layer 103, a second thermoreversible recording layer 104, an ultraviolet absorbing layer 107, a second oxygen barrier layer 106 in this order over the support 101, and further has a back layer 108 on the surface of the support 101 opposite to the surface over which the first and second thermoreversible recording layers 103 and 104 and the like are formed.

Figure 10D:
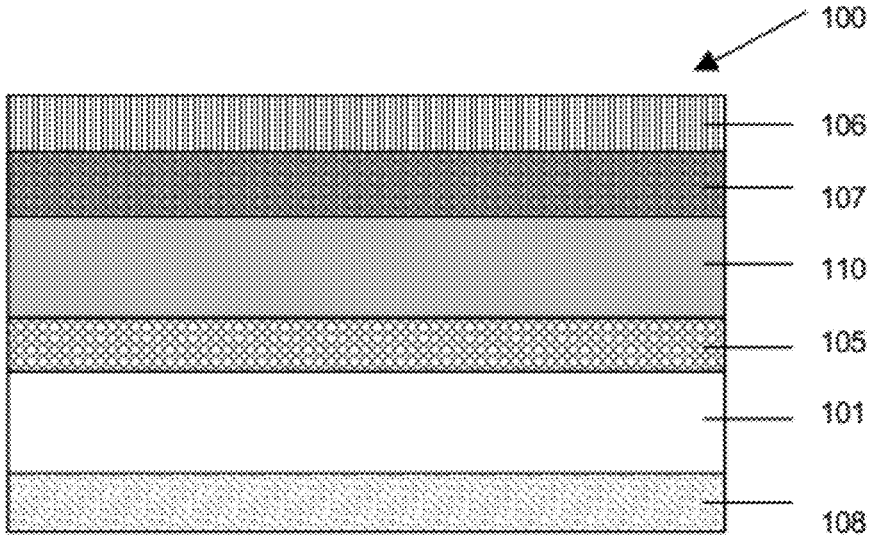
FIG. 10D is a schematic cross-sectional diagram illustrating yet another example of a layer configuration of a thermoreversible recording medium according to the present invention.

Furthermore, as illustrated in FIG. 10D, an aspect of the layer configuration is exemplified in which a thermoreversible recording medium 100 has a support 101, a first oxygen barrier layer 105, a thermoreversible recording layer 110 containing a photothermal conversion material, an ultraviolet absorbing layer 107, and a second oxygen barrier layer 106 in this order over the support 101, and further has a back layer 108 on the surface of the support 101 opposite to the surface over which the thermoreversible recording layers 110 and the like are formed.

Note that although illustration is omitted, a protective layer may be formed on the second thermoreversible recording layer 104 in FIG. 10A, on the second oxygen barrier layer 106 in FIG. 10B, the second oxygen barrier layer 106 in FIG. 10C, and on the second oxygen barrier layer 106 in FIG. 10D, each of these protective layers serving as an uppermost surface layer.

—Support—

The shape, structure, size and the like of the support are suitably selected in accordance with the intended use without any restriction. Examples of the shape include plate-like shapes; the structure may be a single layer structure or a laminated structure; and the size may be suitably selected according to the size of the thermoreversible recording medium, etc.

Examples of the material for the support include inorganic materials and organic materials.

Examples of the inorganic materials include glass, quartz, silicon, silicon oxide, aluminum oxide, $SiO_2$ and metals.

Examples of the organic materials include paper, cellulose derivatives such as cellulose triacetate, synthetic paper, and films made of polyethylene terephthalate, polycarbonates, polystyrene, polymethyl methacrylate, etc.

Each of the inorganic materials and the organic materials may be used alone or in combination. Among these materials, the organic materials are preferable, specifically films made of polyethylene terephthalate, polycarbonates, polymethyl methacrylate, etc. are preferable. Of these, polyethylene terephthalate is particularly preferable.

It is desirable that the support be subjected to surface modification by means of corona discharge, oxidation reaction (using chromic acid, for example), etching, facilitation of adhesion, antistatic treatment, etc. for the purpose of improving the adhesiveness of a coating layer.

Also, it is desirable to color the support white by adding, for example, a white pigment such as titanium oxide to the support.

The thickness of the support is suitably selected in accordance with the intended use without any restriction, with the range of 10 μm to 2,000 μm being preferable and the range of 50 μm to 1,000 μm being more preferable.

—First Thermoreversible Recording Layer and Second Thermoreversible Recording Layer—

The first thermoreversible recording layer and the second thermoreversible recording layer reversibly change in color tone depending on a change in temperature.

Each of the first and second thermoreversible recording layer (which may be hereinafter referred to as "thermoreversible recording layer") includes a leuco dye serving as an electron-donating color-forming compound, a developer serving as an electron-accepting compound, and a binder resin, and further includes other components as required.

The leuco dye serving as an electron-donating color-forming compound and a reversible developer serving as an electron-accepting compound, in which color tone reversibly changes by heat, are materials capable of exhibiting a phenomenon in which visible changes are reversibly produced by temperature change; and the material can relatively change into a colored state and into a decolored state, depending upon the heating temperature and the cooling rate after heating.

—Leuco Dye—

The leuco dye itself is a colorless or pale dye precursor. The leuco dye is not particularly limited and may be suitably selected from known leuco dyes. Preferred examples thereof include leuco compounds based on triphenylmethane phthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene and bislactone. Among these, fluoran-based and phthalide-based leuco dyes are particularly preferable in that they are excellent in coloring and decoloring properties, colorfulness and storage stability. These may be used alone or in combination, and the thermoreversible recording medium can be made suitable for multicolor or full-color recording by providing a layer which color forms with a different color tone.

—Reversible Developer—

The reversible developer is suitably selected in accordance with the intended use without any restriction, provided that it is capable of reversibly developing and erasing color by means of heat. Suitable examples thereof include a compound having in its molecule at least one of the following structures: a structure (1) having such a color-developing ability as makes the leuco dye develop color (e.g., a phenolic hydroxyl group, a carboxylic acid group, a phosphoric acid group, etc.); and a structure (2) which controls cohesion among molecules (e.g., a structure in which long-chain hydrocarbon groups are linked together). In the linked site, the long-chain hydrocarbon group may be linked via a divalent or higher linking group containing a hetero atom. Additionally, the long-chain hydrocarbon groups may contain at least either similar linking groups or aromatic groups.

For the structure (1) having such a color-developing ability as makes the leuco dye develop color, phenol is particularly suitable.

For the structure (2) which controls cohesion among molecules, long-chain hydrocarbon groups having 8 or more carbon atoms, preferably 11 or more carbon atoms, are suitable, and the upper limit of the number of carbon atoms is preferably 40 or less, more preferably 30 or less.

Among the reversible developers, a phenol compound represented by General Formula (1) is preferable, and a phenol compound represented by General Formula (2) is more preferable.

General Formula (1)

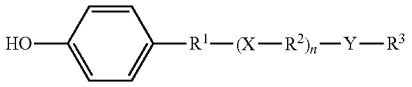

General Formula (2)

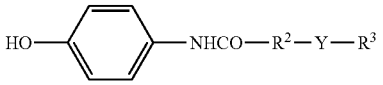

In General Formulae (1) and (2), $R^1$ denotes a single bond or an aliphatic hydrocarbon group having 1 to 24 carbon atoms. $R^2$ denotes an aliphatic hydrocarbon group having 2 or more carbon atoms, which may have a substituent, and the number of the carbon atoms is preferably 5 or greater, more preferably 10 or greater. $R^3$ denotes an aliphatic hydrocarbon group having 1 to 35 carbon atoms, and the number of the carbon atoms is preferably 6 to 35, more preferably 8 to 35. Each of these aliphatic hydrocarbon groups may be provided alone or in combination.

The sum of the numbers of carbon atoms which $R^1$, $R^2$ and $R^3$ have is suitably selected in accordance with the intended use without any restriction, with its lower limit being preferably 8 or greater, more preferably 11 or greater, and the upper limit being preferably 40 or less, more preferably 35 or less.

When the sum of the numbers of carbon atoms is less than 8, coloring stability or decoloring ability may degrade.

Each of the aliphatic hydrocarbon groups may be a straight-chain group or a branched-chain group and may have an unsaturated bond, with preference being given to a straight-chain group. Examples of the substituent bonded to the aliphatic hydrocarbon group include a hydroxyl group, halogen atoms and alkoxy groups.

In General Formulae (1) and (2), X and Y may be identical or different, each representing an N atom-containing or O atom-containing divalent group. Specific examples thereof include an oxygen atom, amide group, urea group, diacylhydrazine group, diamide oxalate group and acylurea group, with amide group and urea group being preferable.

In General Formulae (1) and (2), "n" is an integer of 0 to 1.

The electron-accepting compound (developer) is not particularly limited, however, it is desirable that the electron-accepting compound be used together with a compound as a color erasure accelerator having in its molecule at least one of —NHCO— group and —OCONH— group because intermolecular interaction is induced between the color erasure accelerator and the developer in a process of producing a decolored state, thereby improving the coloring and decoloring properties.

The color erasure accelerator is suitably selected in accordance with the intended use without any restriction.

For the thermoreversible recording layer, a binder resin and, if necessary, additives for improving or controlling the coating properties and coloring and decoloring properties of the recording layer may be used. Examples of these additives include a surfactant, a conductive agent, a filling agent, an antioxidant, a light stabilizer, a coloring stabilizer and a color erasure accelerator.

—Binder Resin—

The binder resin is suitably selected in accordance with the intended use without any restriction, provided that it enables the recording layer to be bonded onto the support. For instance, one of conventionally known resins or a combination of two or more thereof may be used for the binder resin. Among these resins, resins capable of being cured by heat, an ultraviolet ray, an electron beam or the like are preferable in that the durability at the time of repeated use can be improved, with particular preference being given to thermally curable resins each containing an isocyanate compound or the like as a cross-linking agent. Examples of the thermally curable resins include a resin having a group which reacts with a cross-linking agent, such as a hydroxyl group or carboxyl group, and a resin produced by copolymerizing a hydroxyl group-containing or carboxyl group-containing monomer and other monomer. Specific examples of such thermally curable resins include phenoxy resins, polyvinyl butyral resins, cellulose acetate propionate resins, cellulose acetate butyrate resins, acrylpolyol resins, polyester polyol resins and polyurethane polyol resins, with particular preference being given to acrylpolyol resins, polyester polyol resins and polyurethane polyol resins.

The mixture ratio (mass ratio) of the color former to the binder resin in the recording layer is preferably in the range of 1:0.1 to 1:10. When the amount of the binder resin is too small, the recording layer may be deficient in thermal strength. When the amount of the binder resin is too large, it is problematic because the coloring density decreases.

The cross-linking agent is suitably selected in accordance with the intended use without any restriction, and examples thereof include isocyanates, amino resins, phenol resins, amines and epoxy compounds. Among these, isocyanates are preferable, and polyisocyanate compounds each having a plurality of isocyanate groups are particularly preferable.

As to the amount of the cross-linking agent added relative to the amount of the binder resin, the ratio of the number of functional groups contained in the cross-linking agent to the number of active groups contained in the binder resin is preferably in the range of 0.01:1 to 2:1. When the amount of the cross-linking agent added is so small as to be outside this range, sufficient thermal strength cannot be obtained. When the amount of the cross-linking agent added is so large as to be outside this range, there is an adverse effect on the coloring and decoloring properties.

Further, as a cross-linking promoter, a catalyst utilized in this kind of reaction may be used.

The gel fraction of any of the thermally curable resins when thermally cross-linked is preferably 30% or more, more preferably 50% or more, and still more preferably 70% or more. When the gel fraction is less than 30%, an adequate cross-linked state cannot be produced, and thus the durability may degrade.

As to a method for distinguishing between a cross-linked state and a non-cross-linked state of the binder resin, these two states can be distinguished by immersing a coating film in a solvent having high dissolving ability, for example. Specifically, with respect to the binder resin in a non-cross-linked state, the resin dissolves in the solvent and thus does not remain in a solute.

The above-mentioned other components in the recording layer are suitably selected in accordance with the intended use without any restriction. For instance, a surfactant, a plasticizer and the like are suitable therefor in that recording of an image can be facilitated.

For a solvent, a coating solution dispersing device, a recording layer applying method, a drying and curing method and the like used for the thermoreversible recording layer coating liquid, those that are known can be applied.

To prepare the thermoreversible recording layer coating liquid, materials may be together dispersed into a solvent using the dispersing device; alternatively, the materials may be independently dispersed into respective solvents and then the solutions may be mixed together. Further, the ingredients may be heated and dissolved, and then they may be precipitated by rapid cooling or slow cooling.

The method for forming the thermoreversible recording layer is suitably selected in accordance with the intended use without any restriction. Suitable examples thereof include a method (1) of applying onto a support a thermoreversible recording layer coating liquid in which the resin, the leuco dye and the reversible developer are dissolved or dispersed in a solvent, then cross-linking the coating solution while or after forming it into a sheet or the like by evaporation of the solvent; a method (2) of applying onto a support a thermoreversible recording layer coating liquid in which the leuco dye and the reversible developer are dispersed in a solvent in which only the resin is dissolved, then cross-linking the coating solution while or after forming it into a sheet or the like by evaporation of the solvent; and a method (3) of not using a solvent and heating and melting the resin, the leuco dye and the reversible developer so as to mix, then cross-linking this melted mixture after forming it into a sheet or the like and cooling it. In each of these methods, it is also possible to produce the recording layer as a thermoreversible recording medium in the form of a sheet without using the support.

The solvent used in (1) or (2) cannot be unequivocally defined, as it is affected by the types, etc. of the resin, the leuco dye and the reversible developer. Examples thereof include tetrahydrofuran, methyl ethyl ketone, methyl isobutyl ketone, chloroform, carbon tetrachloride, ethanol, toluene and benzene.

Additionally, the reversible developer is present in the recording layer, being dispersed in the form of particles.

A pigment, an antifoaming agent, a dispersant, a slip agent, an antiseptic agent, a cross-linking agent, a plasticizer and the like may be added into the thermoreversible recording layer coating liquid, for the purpose of exhibiting high performance as a coating material.

The coating method for the thermoreversible recording layer may be suitably selected in accordance with the intended use without any restriction. For instance, a support which is continuous in the form of a roll or which has been cut into the form of a sheet is conveyed, and the support is coated with the recording layer by a known method such as blade coating, wire bar coating, spray coating, air knife coating, bead coating, curtain coating, gravure coating, kiss coating, reverse roll coating, dip coating or die coating.

The drying conditions of the thermoreversible recording layer coating liquid are suitably selected in accordance with the intended use without any restriction. For instance, the thermoreversible recording layer coating liquid is dried at room temperature to a temperature of 140° C., for about 10 seconds to about 10 minutes.

The thickness of the thermoreversible recording layer is suitably selected in accordance with the intended use without any restriction. For instance, it is preferably 1 μm to 20 μm, more preferably 3 μm to 15 μm. When the thermoreversible recording layer is too thin, the contrast of an image may lower because the coloring density lowers. When the thermoreversible recording layer is too thick, the heat distribution in the layer increases, a portion which does not reach a coloring temperature and so does not form color is created, and thus a desired coloring density may be unable to be obtained.

—Photothermal Conversion Layer—

The photothermal conversion layer contains at least a photothermal conversion material having a function to absorb a laser light and generate heat. It is particularly preferable that the photothermal conversion material is incorporated into at least one of the thermoreversible recording layer and an adjacent layer of the thermoreversible recording layer. When the photothermal conversion material is incorporated into the thermoreversible recording layer, the thermoreversible recording layer will also serve as the photothermal conversion layer. A barrier layer may be formed between the thermoreversible recording layer and the photothermal conversion layer for the purpose of inhibiting an interaction therebetween. The barrier layer is preferably formed by using a material having high thermal conductivity. The layer formed between the thermoreversible recording layer and the photothermal conversion layer is suitably selected in accordance with the intended use is not limited to the barrier layer.

The photothermal conversion material is broadly classified into inorganic materials and organic materials.

The inorganic materials are not particularly limited and examples thereof include carbon black, metals such as Ge, Bi, In, Te, Se, and Cr, or semi-metals thereof and alloys thereof; metal boride particles, and metal oxide particles.

Preferred examples of the metal borides and metal oxides include hexa-borides, tungsten oxide compounds, antimony-doped tin oxides (ATO), tin-doped indium oxides (ITO), and antimony zinc oxides.

The organic materials are not particularly limited, and various dyes can be suitably used in accordance with the wavelength of light to be absorbed, and a near-infrared absorption pigment having an absorption peak near wavelengths of 700 nm to 1,500 nm is used. Specific examples thereof include cyanine pigments, quinone, quinoline derivatives of indonaphthol, phenylene diamine nickel complexes, and phthalocyanine pigments. To perform repeated image processing, it is preferable to select a photothermal conversion material that is excellent in heat resistance, with particular preference being given to phthalocyanine pigments.

Each of the near-infrared absorption pigments may be used alone or in combination.

When the photothermal conversion layer is formed, the photothermal conversion material is typically used in combination with a resin.

The resin used in the photothermal conversion layer is suitably selected from among those known in the art without any restriction, as long as it can maintain the inorganic material and the organic material therein, with preference being given to a thermoplastic resin and a thermally curable resin. Of these resins, resins curable with hest, an ultraviolet ray, an electron beam or the like are preferably used for improving the durability at the time of repeated use, and a thermally crosslinkable resin using an isocyanate-based compound as a crosslinking agent is preferable. The hydroxyl value of the binder resin is preferably 50 mgKOH/g to 400 mgKOH/g.

The thickness of the photothermal conversion layer may be suitably selected in accordance with the intended use without particular restriction. It is, however, preferably 0.1 μm to 20 μm.

—First Oxygen Barrier Layer and Second Oxygen Barrier Layer—

The first oxygen barrier layer and the second oxygen barrier layer (hereinafter, which may be otherwise referred to as "oxygen barrier layer") are provided for the purpose of preventing oxygen from entering the first and second thermoreversible recording layers, thereby preventing optical degradation of the leuco dye in the first and second thermoreversible recording layers. These oxygen barrier layers are preferably provided on and under the first and second thermoreversible recording layer. That is, it is preferable that the first oxygen barrier layer be provided between the support and the first thermoreversible recording layer, and the second oxygen barrier layer be provided on the second thermoreversible recording layer.

The oxygen barrier layers have high permeability in the visible part of the spectrum, and thus as a material therefor, a resin having low oxygen permeability or a polymer film is exemplified, for example.

The material of the oxygen barrier layers are selected depending on the application use, the oxygen permeability, the transparency, the ease of coating, the adhesiveness, and the like.

Specific examples of the material for the oxygen barrier layers include resins such as polyacrylic alkyl ester, polymethacrylic alkyl ester, polymethacrylonitrile, polyvinyl alkyl ester, polyvinyl alkyl ether, polyvinyl fluoride, polystyrene, vinyl acetate copolymers, cellulose acetate, polyvinyl alcohol, polyvinylidene chloride, acetonitrile copolymers, vinylidene chloride copolymers, poly(chlorotrifluoroethylene), ethylene-vinyl alcohol copolymers, polyacrylonitrile, acrylonitrile copolymers, polyethylene terephthalate, nylon-6, and polyacetal; a silica-deposited film in which an inorganic oxide is vapor-deposited on a polymer film such as polyethylene terephthalate, and nylon; an alumina-deposited film; and a silica/alumina-deposited film. Among these, a film obtained by vapor-depositing an inorganic oxide on a polymer film is preferable.

The oxygen permeability of the oxygen barrier layers is preferably 20 $mL/m^2/day/MPa$ or lower, more preferably 5 $mL/m^2/day/MPa$ or lower, and still more preferably 1 $mL/m^2/day/MPa$ or lower. When the oxygen permeability is higher than 20 $mL/m^2/day/MPa$, the leuco dye in the first and second thermoreversible recording layers may be suffered from optical degradation.

The oxygen permeability can be measured according to the measurement method described in JIS K7126 B.

The oxygen barrier layers may also be provided so that the thermoreversible recording layer is sandwiched by them. With this, intrusion of oxygen into the thermoreversible recording layers can be efficiently prevented, and optical degradation of the leuco dye can be further decreased.

The method of forming the oxygen barrier layers may be suitably selected in accordance with the intended use without any restriction. Examples thereof include melt extrusion methods, coating methods, and laminating methods.

The thickness of the first oxygen barrier layer and the second oxygen barrier layer is not particularly limited and varies depending on the oxygen permeability of the resin or polymer film used. The thickness is preferably 0.1 μm to 100 μm. when the thickness thereof is less than 0.1 μm, the oxygen barrier property is imperfect, and when it is more than 100 μm, unfavorably the transparency degrades.

An adhesive layer may be provided between the oxygen barrier layer and an underlying layer which is provided under the oxygen barrier layer.

The method of forming the adhesive layer is not particularly limited, and examples thereof include known coating methods and known laminating methods.

The thickness of the adhesive layer is not particularly limited, however, it is preferably 0.1 μm to 5 μm. The adhesive layer may be cured with a crosslinker. The same crosslinker as used for the thermoreversible recording layers can be suitably used.

—Protective Layer—

In the thermoreversible recording medium, it is desirable that a protective layer be provided on the thermoreversible recording layer, for the purpose of protecting the thermoreversible recording layer.

The protective layer is suitably selected in accordance with the intended use without any restriction. For instance, the protective layer may be formed from one or more layers, and it is preferably provided on the outermost surface that is exposed.

The protective layer contains a binder resin and further contains other components such as a filler, a lubricant and a coloring pigment as required.

The resin in the protective layer is suitably selected in accordance with the intended use without any restriction. For instance, the resin is preferably a thermally curable resin, an ultraviolet (UV) curable resin, an electron beam curable resin, etc., with particular preference being given to an ultraviolet (UV) curable resin and a thermally curable resin.

The UV-curable resin can form a very hard film after cured, and reducing damage done by physical contact of the surface and deformation of the medium caused by laser heating; therefore, it is possible to obtain a thermoreversible recording medium superior in durability against repeated use.

Although slightly inferior to the UV-curable resin, the thermally curable resin makes it possible to harden the surface as well and is superior in durability against repeated use.

The UV-curable resin is suitably selected from known UV-curable resins in accordance with the intended use without any restriction. Examples thereof include oligomers based on urethane acrylates, epoxy acrylates, polyester acrylates, polyether acrylates, vinyls and unsaturated polyesters; and monomers such as monofunctional and multifunctional acrylates, methacrylates, vinyl esters, ethylene derivatives and allyl compounds. Of these, multifunctional, i.e. tetrafunctional or higher, monomers and oligomers are particularly preferable. By mixing two or more of these monomers or oligomers, it is possible to suitably adjust the hardness, degree of contraction, flexibility, coating strength, etc. of the resin film.

To cure the monomers and the oligomers with an ultraviolet ray, it is necessary to use a photopolymerization initiator or a photopolymerization accelerator.

The amount of the photopolymerization initiator or the photopolymerization accelerator added is preferably 0.1% by mass to 20% by mass, more preferably 1% by mass to 10% by mass, relative to the total mass of the resin component of the protective layer.

Ultraviolet irradiation for curing the ultraviolet curable resin can be conducted using a known ultraviolet irradiator, and examples of the ultraviolet irradiator include one equipped with a light source, a lamp fitting, a power source, a cooling device, a conveyance device, etc.

Examples of the light source include a mercury-vapor lamp, a metal halide lamp, a potassium lamp, a mercury-xenon lamp and a flash lamp. The wavelength of the light source may be suitably selected according to the ultraviolet absorption wavelength of the photopolymerization initiator and the photopolymerization accelerator added to the thermoreversible recording medium composition.

The conditions of the ultraviolet irradiation are suitably selected in accordance with the intended use without any restriction. For instance, it is advisable to decide the lamp output, the conveyance speed, etc. according to the irradiation energy necessary to cross-link the resin.

In order to improve the conveyance capability, a releasing agent such as a silicone having a polymerizable group, a silicone-grafted polymer, wax or zinc stearate; or a lubricant such as silicone oil may be added. The amount of any of these added is preferably 0.01% by mass to 50% by mass, more preferably 0.1% by mass to 40% by mass, relative to the total mass of the resin component of the protective layer. Each of these may be used alone or in combination. Additionally, in order to prevent static electricity, a conductive filler is preferably used, more preferably a needle-like conductive filler.

The particle diameter of the inorganic pigment is not particularly limited, and for example, preferably 0.01 μm to 10.0 μm, more preferably 0.05 μm to 8.0 μm. The amount of the inorganic pigment added is not particularly limited, however, it is preferably 0.001 parts by mass to 2 parts by mass, more preferably 0.005 parts by mass to 1 part by mass, relative to 1 part by mass of the resin.

Further, a surfactant, a leveling agent, an antistatic agent and the like that are conventionally known may be contained in the protective layer as additives.

Also, the thermally curable resin is not particularly limited, for example, a resin similar to the binder resin used for the thermoreversible recording layer can be suitably used, for instance.

The thermally curable resin is preferably crosslinked. Therefore, as the thermally curable resin, a thermally curable resin having a group reactive with a curing agent (e.g., a hydroxyl group, amino group, and carboxyl group) is preferably used, with particular preference being given to a polymer having a hydroxyl group. To increase the strength of the polymer-containing layer having an ultraviolet absorbing structure, that is, it is preferable to use a polymer having a hydroxyl value of 10 mgKOH/g or higher, because a sufficient coat film strength can be obtained. The hydroxyl value of the polymer is more preferably 30 mgKOH/g or higher, and still more preferably 40 mgKOH/g or higher. By making the protective layer have adequate coating strength, it is possible to reduce degradation of the thermoreversible recording medium even when image recording and erasure are repeatedly carried out.

The curding agent is not particularly limited, for example, a curing agent similar to the one used for the thermoreversible recording layer can be suitably used.

For a solvent, a coating solution dispersing device, a recording layer applying method, a drying and curing method and the like used for the protective layer coating liquid, those that are known and used for the thermoreversible recording layer can be applied. When an ultraviolet curable resin is used, a curing step by means of the ultraviolet irradiation with which coating and drying have been carried out is required, in which case the ultraviolet irradiator, the light source and the irradiation conditions described above are employed.

The thickness of the protective layer is preferably 0.1 μm to 20 μm, more preferably 0.5 μm to 10 μm, particularly preferably 1.5 μm to 6 μm. When the thickness is less than 0.1 μm, the protective layer cannot fully perform the function as a protective layer of the thermoreversible recording medium, the thermoreversible recording medium easily degrades through repeated use of heat, and thus it may become unable to be used repeatedly. When the thickness is greater than 20 μm, it is impossible to pass adequate heat to a thermosensitive section situated under the protective layer, and thus printing and erasure of an image by heat may become unable to be sufficiently performed.

—Ultraviolet Absorbing Layer—

For the purpose of preventing erasure residue of the leuco dye in the thermoreversible recording layer caused by degradation of color and a light beam thermoreversible recording layer, it is desirable to provide an ultraviolet absorbing layer on the side of thermoreversible recording layer which is positioned opposite the support, thereby the optical resistance of the thermoreversible recording medium can be improved. Preferably, the thickness of the ultraviolet absorbing layer is suitably selected so that the ultraviolet absorbing layer absorbs an ultraviolet ray having a wavelength of 390 nm or lower.

The ultraviolet absorbing layer includes at least a binder resin and an ultraviolet absorber and further includes other components such as a filler, a lubricant and a coloring pigment, as required.

The binder resin is suitably selected in accordance with the intended use without any restriction. The binder resin used in the thermoreversible recording layer, a thermoplastic resin and a thermally curable resin can be used. Examples of the resin components include polyethylene, polypropylene, polystyrene, polyvinyl alcohol, polyvinyl butyral, polyurethane, saturated polyesters, unsaturated polyesters, epoxy resins, phenol resins, polycarbonates, and polyamides.

The ultraviolet absorber is not particularly limited, and both an organic compound and an inorganic compound can be used therefor.

Also, it is preferable to use a polymer having an ultraviolet absorbing structure (hereinafter otherwise referred to as "ultraviolet absorbing polymer").

Here, the term "the polymer having an ultraviolet absorbing structure" means a polymer having an ultraviolet absorbing structure (e.g. ultraviolet absorbing group) in its molecule. Examples of the ultraviolet absorbing structure include salicylate structure, cyanoacrylate structure, benzotriazole structure and benzophenone structure. Of these, benzotriazole structure and benzophenone structure are particularly preferable for their capability of absorbing an ultraviolet ray having a wavelength of 340 nm to 400 nm, which causes optical degradation of leuco dyes.

The ultraviolet absorbing polymer is not particularly limited, however, it is preferably crosslinked. Therefore, as the ultraviolet absorbing polymer, an ultraviolet absorbing polymer having a group reactive with a curing agent (e.g., a hydroxyl group, amino group, and carboxyl group) is preferably used, with particular preference being given to a polymer having a hydroxyl group. To increase the strength of the polymer-containing layer having an ultraviolet absorbing structure, that is, it is preferable to use a polymer having a hydroxyl value of 10 mgKOH/g or higher, because a sufficient coat film strength can be obtained. The hydroxyl value of the polymer is more preferably 30 mgKOH/g or higher, and still more preferably 40 mgKOH/g or higher. By making the ultraviolet absorbing layer have adequate coating strength, it is possible to reduce degradation of the thermoreversible recording medium even when image recording and erasure are repeatedly carried out.

The thickness of the ultraviolet absorbing layer is preferably 0.1 μm to 30 μm, more preferably 0.5 μm to 20 μm.

For a solvent, a coating solution dispersing device, a recording layer applying method, a drying and curing method and the like used for the ultraviolet absorbing layer coating liquid, those that are known and used for the thermoreversible recording layer can be applied.

—Intermediate Layer—

It is desirable to provide an intermediate layer between the thermoreversible recording layer and the protective layer, for the purpose of improving adhesiveness between the thermoreversible recording layer and the protective layer, preventing change in the quality of the thermoreversible recording layer caused by application of the protective layer, and preventing the additives in the protective layer from transferring to the thermoreversible recording layer. This makes it possible to improve the ability to store a colored image.

The intermediate layer contains at least a binder resin and further contains other components such as a filler, a lubricant and a coloring pigment.

The binder resin may be suitably selected in accordance with the intended use without any restriction, and the binder resin used for the thermoreversible recording layer or a resin component such as a thermoplastic resin or thermally curable resin may be used. Examples of the resin component include polyethylene, polypropylene, polystyrene, polyvinyl alcohol, polyvinyl butyral, polyurethane, saturated polyesters, unsaturated polyesters, epoxy resins, phenol resins, polycarbonates and polyamides.

It is desirable that the intermediate layer contain an ultraviolet absorber. For the ultraviolet absorber, both an organic compound and an inorganic compound may be used.

Also, an ultraviolet absorbing polymer may be used, and this may be cured by a cross-linking agent. As these compounds, compounds similar to those used for the protective layer can be suitably used.

The thickness of the intermediate layer is not particularly limited, however, it is preferably 0.1 μm to 20 μm, more preferably 0.5 μm to 5 μm. For a solvent, a coating solution dispersing device, an intermediate layer applying method, an intermediate layer drying and hardening method and the like used for the intermediate layer coating liquid, those that are known and used for the thermoreversible recording layer can be applied.

—Under Layer—

An under layer may be provided between the thermoreversible recording layer and the support, for the purpose of effectively utilizing applied heat for high sensitivity, or improving adhesiveness between the support and the thermoreversible recording layer, and preventing permeation of thermoreversible recording layer materials into the support.

The under layer contains at least hollow particles, also contains a binder resin and further contains other components as required.

The hollow particles are not particularly limited. Examples of the hollow particles include single hollow particles in which only one hollow portion is present in each particle, and multi hollow particles in which numerous hollow portions are present in each particle. These types of hollow particles may be used independently or in combination.

The material for the hollow particles is suitably selected in accordance with the intended use without any restriction, and suitable examples thereof include thermoplastic resins. For the hollow particles, suitably produced hollow particles may be used, or a commercially available product may be used. Examples of the commercially available product include MICROSPHERE R-300 (produced by Matsumoto Yushi-Seiyaku Co., Ltd.); ROPAQUE HP1055 and ROPAQUE HP433J (both of which are produced by Zeon Corporation); and SX866 (produced by JSR Corporation).

The amount of the hollow particles added to the under layer is suitably selected in accordance with the intended use without any restriction, and it is preferably 10% by mass to 80% by mass, for instance.

The binder resin is not particularly limited, and a resin similar to the resin used for the thermoreversible recording layer or used for the layer which contains the polymer having an ultraviolet absorbing structure can be used.

The under layer may contain at least one of an organic filler and an inorganic filler such as calcium carbonate, magnesium carbonate, titanium oxide, silicon oxide, aluminum hydroxide, kaolin or talc.

Besides, the under layer may contain a lubricant, a surfactant, a dispersant and the like.

The thickness of the under layer is suitably selected in accordance with the intended use without any restriction, with the range of 0.1 μm to 50 μm being preferable, the range of 2 μm to 30 μm being more preferable, and the range of 12 μm to 24 μm being still more preferable.

—Back Layer—

For the purpose of preventing curl and static charge on the thermoreversible recording medium and improving the conveyance capability, a back layer may be provided on the surface of the support opposite to the surface where the thermoreversible recording layer is formed.

The back layer contains at least a binder resin and further contains other components such as a filler, a conductive filler, a lubricant and a coloring pigment as required.

The binder resin may be suitably selected in accordance with the intended use without any restriction. For example, the binder resin is any one of a thermally curable resin, an ultraviolet (UV) curable resin, an electron beam curable resin, etc., with particular preference being given to an ultraviolet (UV) curable resin and a thermally curable resin.

For the ultraviolet curable resin, the thermally curable resin, the filler, the conductive filler and the lubricant, ones similar to those used for the thermoreversible recording layer, the protective layer or the intermediate layer can be suitably used.

—Adhesive Layer or Tackiness Layer— the thermoreversible recording medium can be produced as a thermoreversible recording label by providing an adhesive layer or a tackiness layer on the surface of the support opposite to the surface where the thermoreversible recording layer is formed. The material for the adhesive layer or the tackiness layer can be selected from commonly used materials.

The material for the adhesive layer or the tackiness layer may be suitably selected in accordance with the intended purpose without any restriction. Examples thereof include urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins and silicone resins.

The material for the adhesive layer or the tackiness layer is not particularly limited and may be of a hot-melt type.

Release paper may or may not be used. By providing the adhesive layer or the tackiness layer, the thermoreversible recording label can be affixed to a whole surface or a part of a thick substrate such as a magnetic stripe-attached vinyl chloride card, which is difficult to coat with a thermoreversible recording layer. This makes it possible to improve the convenience of this medium, for example to display part of information stored in a magnetic recorder. The thermoreversible recording label provided with such an adhesive layer or tackiness layer can also be used on thick cards such as IC cards and optical cards.

In the thermoreversible recording medium, a coloring layer may be provided between the support and the thermoreversible recording layer, for the purpose of improving visibility. The coloring layer can be formed by applying a dispersion solution or a solution containing a colorant and a resin binder over a target surface and drying the dispersion solution or the solution; alternatively, the coloring layer can be formed by simply bonding a coloring sheet to the target surface.

The thermoreversible recording medium may be provided with a color printing layer. A colorant in the color printing layer is, for example, selected from dyes, pigments and the like contained in color inks used for conventional full-color printing. Examples of the resin binder include thermoplastic resins, thermally curable resins, ultraviolet curable resins and electron beam curable resins. The thickness of the color printing layer may be suitably selected according to the desired printed color density.

In the thermoreversible recording medium, an irreversible thermoreversible recording layer may be additionally used. In this case, the colored color tones of the thermoreversible recording layers may be identical or different. Also, a coloring layer which has been printed in accordance with offset printing, gravure printing, etc. or which has been printed with any pictorial design or the like using an ink-jet printer, a thermal transfer printer, a sublimation printer, etc., for example, may be provided on the whole or a part of the same surface of the thermoreversible recording medium of the present invention as the surface where the thermoreversible recording layer is formed, or may be provided on a part of the opposite surface thereof. Further, an OP varnish layer composed mainly of a curable resin may be provided on a part or the whole surface of the coloring layer. Examples of the pictorial design include letters/characters, patterns, diagrams, photographs, and information detected with an infrared ray. Also, any of the layers that are simply formed may be colored by addition of dye or pigment.

Further, the thermoreversible recording medium may be provided with a hologram for security. Also, to give variety in design, it may also be provided with a design such as a portrait, a company emblem or a symbol by forming depressions and protrusions in relief or in intaglio.

The thermoreversible recording medium may be formed into a desired shape according to its use, for example into a card, a tag, a label, a sheet or a roll. The thermoreversible recording medium in the form of a card can be used for prepaid cards, discount cards, i.e. so-called point cards, credit cards and the like. The thermoreversible recording medium in the form of a tag that is smaller in size than the card can be used for price tags and the like. The thermoreversible recording medium in the form of a tag that is larger in size than the card can be used for tickets, sheets of instruction for process control and shipping, and the like. The thermoreversible recording medium in the form of a label can be affixed; accordingly, it can be formed into a variety of sizes and, for example, used for process control and product control, being affixed to carts, receptacles, boxes, containers, etc. to be repeatedly used. The thermoreversible recording medium in the form of a sheet that is larger in size than the card offers a larger area for image formation, and thus it can be used for general documents and sheets of instruction for process control, for example.

—Example of Combination of Thermoreversible Recording Member and RF-ID—

A thermoreversible recording member used in the present invention is superior in convenience because the thermoreversible recording layer capable of reversible display, and an information storage section are provided on the same card or tag (so as to form a single unit), and part of information stored in the information storage section is displayed on the thermoreversible recording layer, thereby making it is possible to confirm the information by simply looking at a card or a tag without needing a special device. Also, when information stored in the information storage section is rewritten, rewriting of information displayed by the thermoreversible recording member makes it possible to use the thermoreversible recording medium repeatedly as many times as desired.

The information storage section is suitably selected in accordance with the intended use without any restriction, and suitable examples thereof include a magnetic thermoreversible recording layer, a magnetic stripe, an IC memory, an optical memory and an RF-ID tag. In the case where the information storage section is used for process control, product control, etc., an RF-ID tag is particularly preferable. The RF-ID tag is composed of an IC chip, and an antenna connected to the IC chip.

The thermoreversible recording member includes the thermoreversible recording layer capable of reversible display, and the information storage section. Suitable examples of the information storage section include an RF-ID tag.

Figure 7:
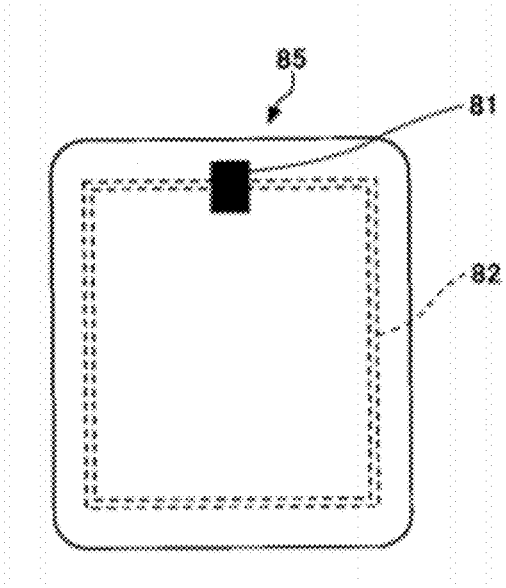
FIG. 7 is a schematic diagram illustrating one example of an RF-ID tag.

Here, FIG. 7 illustrates a schematic diagram of an example of an RF-ID tag 85. This RF-ID tag 85 is composed of an IC chip 81, and an antenna 82 connected to the IC chip 81. The IC chip 81 is divided into four sections, i.e. a storage section, a power adjusting section, a transmitting section and a receiving section, and communication is conducted as they perform their operations allotted. As for the communication, the RF-ID tag communicates with an antenna of a reader/writer by means of a radio wave so as to transfer data. Specifically, there are such two methods as follows: an electromagnetic induction method in which the antenna of the RF-ID tag receives a radio wave from the reader/writer, and electromotive force is generated by electromagnetic induction caused by resonance; and a radio wave method in which electromotive force is generated by a radiated electromagnetic field. In both methods, the IC chip inside the RF-ID tag is activated by an electromagnetic field from outside, information inside the chip is converted to a signal, then the signal is emitted from the RF-ID tag. This information is received by the antenna on the reader/writer side and recognized by a data processing unit, and then data processing is carried out on the software side.

The RF-ID tag is formed into a label shape or a card shape and can be affixed to the thermoreversible recording medium. The RF-ID tag may be affixed to the thermoreversible recording layer surface or the back layer surface, preferably to the back surface layer. To stick the RF-ID tag and the thermoreversible recording medium together, a known adhesive or tackiness agent may be used.

Additionally, the thermoreversible recording medium and the RF-ID tag may be integrally formed by lamination or the like and then formed into a card shape or a tag shape.

<Image Recording and Image Erasing Mechanism>

The image recording and image erasing mechanism includes an aspect in which color tone reversibly changes by heat. The aspect is such that a combination of a leuco dye and a reversible developer (hereinafter otherwise referred to as "developer") enables the color tone to reversibly change by heat between a transparent state and a colored state.

Figure 6A:
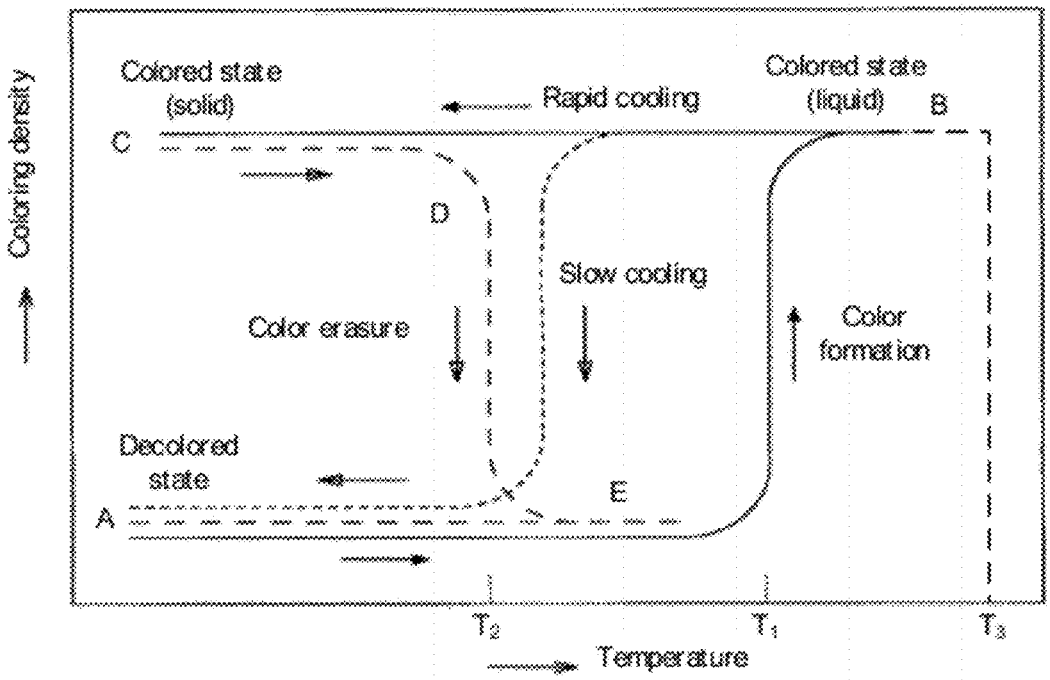
FIG. 6A is a graph illustrating color developing/decoloring properties of a thermoreversible recording medium.
Figure 6B:
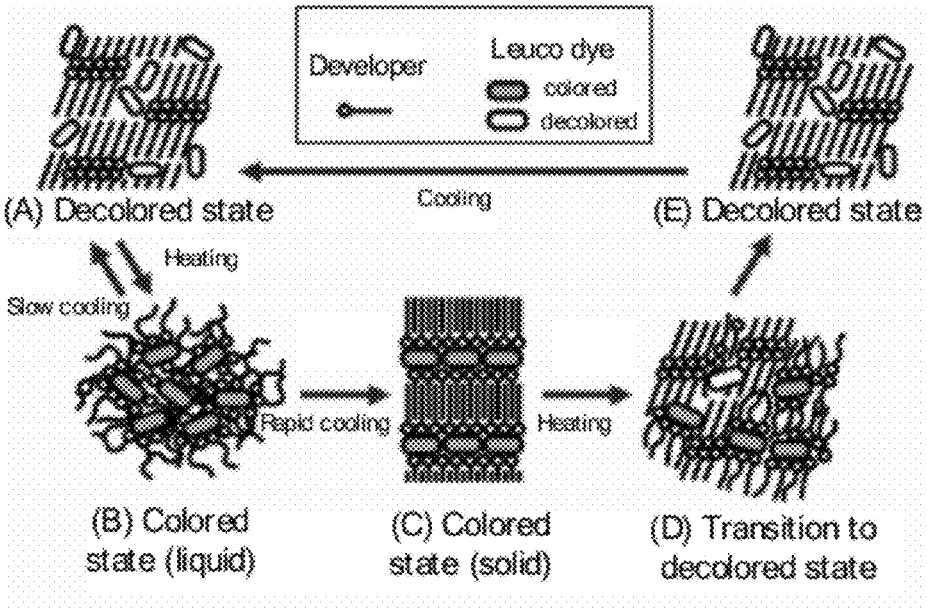
FIG. 6B is a schematic diagram illustrating a coloring and decoloring mechanism of a thermoreversible recording medium.

FIG. 6A illustrates an example of the temperature-coloring density change curve of a thermoreversible recording medium which has a thermoreversible recording layer formed of the resin containing the leuco dye and the developer. FIG. 6B illustrates the coloring and decoloring mechanism of the thermoreversible recording medium which reversibly changes by heat between a transparent state and a colored state.

First of all, when the recording layer in a decolored (colorless) state (A) is raised in temperature, the leuco dye and the developer melt and mix at the melting temperature $T_1$, thereby developing color, and the recording layer thusly comes into a melted and colored state (B). When the recording layer in the melted and colored state (B) is rapidly cooled, the recording layer can be lowered in temperature to room temperature, with its colored state kept, and it thusly comes into a colored state (C) where its colored state is stabilized and fixed. Whether or not this colored state is obtained depends on the temperature decreasing rate from the temperature in the melted state: in the case of slow cooling, the color is erased in the temperature decreasing process, and the recording layer returns to the decolored state (A) it was in at the beginning, or comes into a state where the density is low in comparison with the density in the colored state (C) produced by rapid cooling. When the recording layer in the colored state (C) is raised in temperature again, the color is erased at the temperature $T_2$ lower than the coloring temperature (from D to E), and when the recording layer in this state is lowered in temperature, it returns to the decolored state (A) it was in at the beginning.

The colored state (C) obtained by rapidly cooling the recording layer in the melted state is a state where the leuco dye and the developer are mixed together such that their molecules can undergo contact reaction, which is often a solid state. This state is a state where a melted mixture (coloring mixture) of the leuco dye and the developer crystallizes, and thus color is maintained, and it is inferred that the color is stabilized by the formation of this structure. Meanwhile, the decolored state (A) is a state where the leuco dye and the developer are phase-separated. It is inferred that this state is a state where molecules of at least one of the compounds gather to constitute a domain or crystallize, and thus a stabilized state where the leuco dye and the developer are separated from each other by the occurrence of the flocculation or the crystallization. In many cases, phase separation of the leuco dye and the developer is brought about, and the developer crystallizes in this manner, thereby enabling color erasure with greater completeness.

As to both the color erasure by slow cooling from the melted state and the color erasure by temperature increase from the colored state shown in FIG. 6A, the aggregation structure changes at $T_2$, causing phase separation and crystallization of the developer.

Further, in FIG. 6A, when the temperature of the recording layer is repeatedly raised to the temperature $T_3$ higher than or equal to the melting temperature $T_1$, there may be caused such an erasure failure that an image cannot be erased even if the recording layer is heated to an erasing temperature. It is inferred that this is because the developer thermally decomposes and thus hardly flocculates or crystallizes, which makes it difficult for the developer to separate from the leuco dye. Deterioration of the thermoreversible recording medium caused by repeated image processing can be reduced by decreasing the difference between the melting temperature $T_1$ and the temperature $T_3$ in FIG. 6A when the thermoreversible recording medium is heated.

(Image Processing Apparatus)

The image processing apparatus is an image processing apparatus which records an image composed of lines written with a plurality of laser beams which are arrayed in parallel at predetermined intervals by heating a thermoreversible recording medium with the laser beams; the lines written with the plurality of laser beams include a line written first and an overwritten line, a part of which is overlapped with the line written first. The image processing apparatus includes an image recording unit configured to control the irradiation energy for the overwritten line so as to be smaller than the irradiation energy for the line written first, and other units required for image recording.

The image processing apparatus may be suitably selected in accordance with the intended use without any restrictions, as long as it includes the image recording units. For example, the image processing apparatus is used in reversible image formation and reversible image erasure on a thermoreversible recording medium, the image processing apparatus preferably includes an image erasing unit configured to erase an image formed on the recording medium by heating the recording medium.

The image processing apparatus is used in the image processing method, and includes at least a laser beam irradiation unit and other members suitably selected in accordance with the intended use. Additionally, in the present invention, there is a need to select a wavelength of laser beams emitted therefrom so that the laser beams are highly efficiently absorbed into a medium on which an image is formed. For example, a thermoreversible recording medium according to the present invention contains at least a photothermal conversion material having a roll of absorbing laser beams with high efficiency and generating heat. Therefore, there is to select a wavelength of laser beams emitted therefrom so that the photothermal conversion material absorbs the laser beams with the highest efficiency as compared with other materials.

The image processing apparatus described above preferably includes at least a laser beam emitting unit, an optical scanning unit disposed on a laser-beam emitting surface of the laser beam emitting unit, a light-irradiation-intensity-distribution-adjusting unit configured to alter a light irradiation intensity distribution of a laser beam, and an fθ lens which converges laser beams.

—Laser Beam Emitting Unit—

The laser beam emitting unit can be suitably selected in accordance with the intended use. Examples thereof include a semiconductor laser, a solid laser, a fiber laser, and a $CO_2$ laser. Among these, semiconductor laser beams are particularly preferable in terms of their wide selectivity for wavelength, and enabling a reduction in size of the laser light source itself used in a laser device and downsizing the laser device, in addition to enabling a reduction in production cost.

The wavelength of a semiconductor laser, solid laser or fiber laser beam emitted from the laser beam emitting unit is preferably 700 nm or more, more preferably 720 nm or more, still more preferably 750 nm or more. The uppermost limit of the wavelength of the laser beams can be suitably selected in accordance with the intended use. It is, however, preferably 1,500 nm or less, more preferably 1,300 mm less, particularly preferably 1,200 nm or less.

When the wavelength of the laser beams is shorter than 700 nm, there are problems that in a visible light wavelength region, the contrast of an image decreases when the image is formed on a medium, and the recording medium is colored. In an ultraviolet wavelength region with a wavelength much shorter than the wavelength described above, the medium tends to deteriorate. To ensure high durability to repeated image processing, the photothermal conversion material to be added into a thermoreversible recording medium is required to have a high thermal decomposition temperature, and when an organic dye is used in the photothermal conversion material, it is difficult to obtain a photothermal conversion material having a high decomposition temperature and a long light absorption wavelength. For this reason, the wavelength of the laser beams is preferably 1,500 nm or less.

The wavelength of laser beams emitted from a $CO_2$ laser is 10.6 μm, which is within the far-infrared wavelength region, and the laser beams are absorbed on a surface of a medium without adding, into the recording medium, additives to absorb laser beams and generate heat. In addition, the additives sometimes absorb visible light in a slight amount even when a laser beam having a wavelength in the near-infrared region is used, and thus the $CO_2$ laser which requires no additives is advantageous in that it can prevent a reduction in image contrast.

The image processing apparatus has a basic configuration similar to that of a so-called laser marker, except that it has at least the laser beam emitting unit. For example, the image processing apparatus includes at least an oscillator unit, a power source controlling unit and a program unit.

Figure 5:
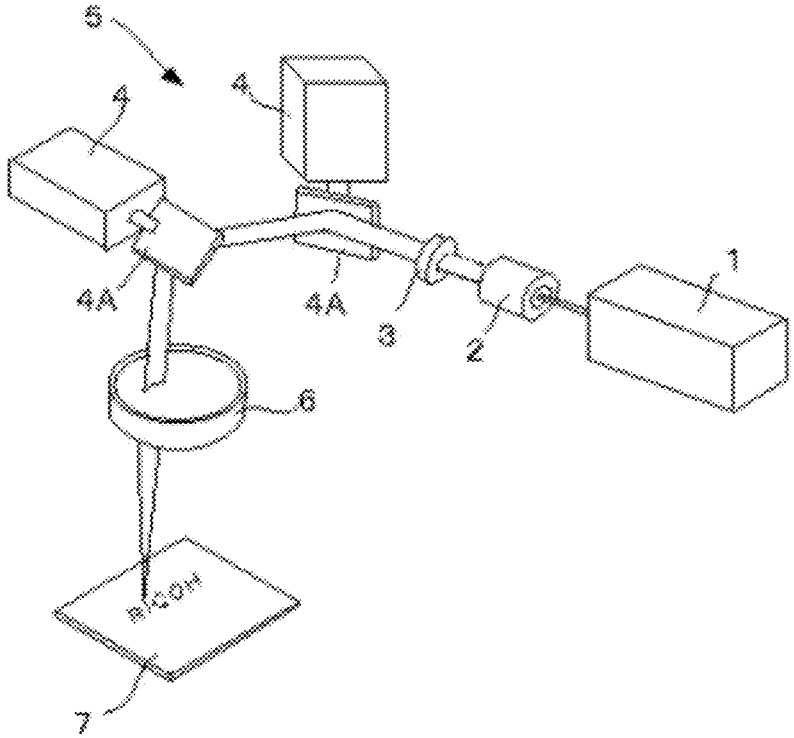
FIG. 5 is a diagram illustrating one example of an image processing apparatus according to the present invention.

Here, one example of the image processing apparatus is illustrated in FIG. 5, with centering on a laser irradiation unit.

An oscillator unit includes a laser oscillator 1, a beam expander 2, a scanning unit 5, an fθ lens 6, and the like. Examples of the optical scanning unit include the scanning unit 5 illustrated in FIG. 5.

The laser oscillator 1 is the one required for obtaining laser beams having high light intensities and high directivity. For example, mirrors are disposed at both sides of a laser medium, and the laser medium is pumped (energy-supplied) to increase the number of atoms in an excited state and form an inverted distribution, thereby bringing about induced emission of laser beams. Then, by selectively amplifying only light beams traveling in an optical axis direction, the directivity of light beams is increased and the laser beams are emitted from an output mirror.

The scanning unit 5 includes a galvanometer 4 and mirrors 4A attached to the galvanometer 4. A laser beam emitted from the laser oscillator 1 is scanned with high speed rotation over a scanning region of a thermoreversible recording medium 7 with the two mirrors A4 each of which is attached to the galvanometer 4 and faces in one of an X direction and an Y direction, whereby an image is formed or erased on the thermoreversible recording medium 7.

The power source controlling unit includes a driving electrical power supply for a light source exciting a laser medium, a driving electrical power supply for galvanometer, a power source for cooling such as Peltier device, a controlling section which controls overall operations of the image processing apparatus, and the like.

The program unit is a unit which inputs conditions of the intensity of laser beam, speed of laser scanning, etc. and creates and edits characters etc. to be recorded, for recording or erasing an image, by inputting data in a touch panel or a keyboard.

The laser irradiation unit, namely, an image recording/erasing head section is loaded on the image processing apparatus, and the image processing apparatus includes, in addition to this unit, a conveying section for conveying the thermoreversible recording medium, a controlling section therefore, a monitoring section (touch panel), and the like.

Other matters of the image processing apparatus are not particularly limited and may be suitably selected from the matters described in the image processing method of the present invention and matters known in the art.

—Light-Irradiation-Intensity-Distribution-Adjusting Unit—

The light-irradiation-intensity-distribution-adjusting unit has a function to alter a light irradiation intensity of the laser beams.

The arrangement of the light-irradiation-intensity-distribution-adjusting unit is not particularly limited, as long as the adjusting unit is disposed on a laser-beam emitting surface of the laser beam irradiation unit, and the distance from the laser beam irradiation unit, or the like can be suitably selected in accordance with the intended use.

The light-irradiation-intensity-distribution-adjusting unit preferably has a function to alter the light intensity distribution on a cross-sectional plane along a direction substantially orthogonal to a traveling direction of the laser beams irradiated, from the Gaussian distribution, so that the intensity of a light beam irradiated on a central portion is equal to or lower than the intensity of a light beam irradiated to peripheral portions. With this function, deterioration of the thermoreversible recording medium due to repeated recording and erasure processing can be reduced, and the repetitive durability thereof can be improved while maintaining high image contrast.

The light-irradiation-intensity-distribution-adjusting unit may be suitably selected without any restrictions. Preferred examples thereof include a lens, a filter, a mask, and a mirror. More specifically, for example, a collide scope, an integrator, a beam-homogenizer, an aspheric beam-shaper (a combination of an intensity conversion lens and a phase correction lens) can be preferably used. In addition, the light irradiation intensity can also be controlled by physically cutting a center portion of the laser beam using a filter, a mask, or the like. When a mirror is used, the light irradiation intensity can be adjusted by using a deformable mirror capable of interfacing with a computer to mechanically deform light beams, mirrors each having a different reflectance or partially different surface irregularities, or the like.

Further, by controlling the distance between the thermoreversible recording medium and the fθ lens, it is also possible to alter the intensity of the laser beam irradiated to the center portion to be equal to or lower than the intensity of the laser beam irradiated to the peripheral portions. In other words, when the distance between the thermoreversible recording medium and the fθ lens is shifted from the focal point distance, the light intensity distribution on a cross-sectional plane along a direction substantially orthogonal to a traveling direction of the laser beams can be changed from the Gaussian distribution to a light intensity distribution where the intensity of laser beams irradiated to the center portion is decreased.

Further, by fiber-coupling a semiconductor laser, an YAG laser, etc., as a laser light source, the light irradiation intensity can be easily adjusted.

The following describes one example of the method of adjusting a light irradiation intensity using an aspheric beam-shaper as the light-irradiation-intensity-distribution-adjusting unit.

Figure 4A:
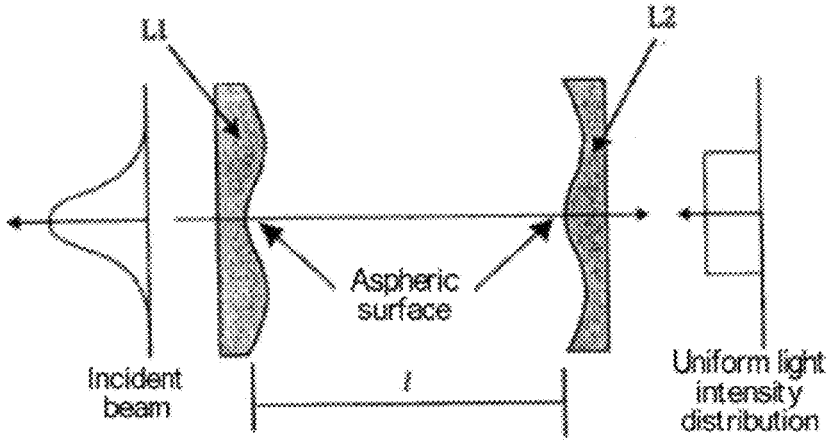
FIG. 4A is a schematic diagram illustrating one example of a light-irradiation intensity controlling unit in an image processing apparatus according to the present invention.

For example, when a combination of an intensity conversion lens and a phase correction lens is used, two sheets of aspheric lenses are provided on an optical path of a laser beam emitted from the laser beam emitting unit, as illustrated in FIG. 4A. Then, by a first sheet of the aspheric lens L1, the light irradiation intensity is converted at a target position (distance l in the figure) so that the light irradiation intensity of a laser beam applied to the center portion in the light intensity distribution is equal to or lower than the light irradiation intensity of a laser beam applied to the peripheral portions (so as to have a flat top shape in FIG. 4A). Subsequently, to propagate in parallel the beams (laser beams) the intensities have been converted, a phase correction is carried out by a second sheet of the aspheric lens L2. As a result, the light intensity distribution having a Gaussian distribution can be changed.

Figure 4B:
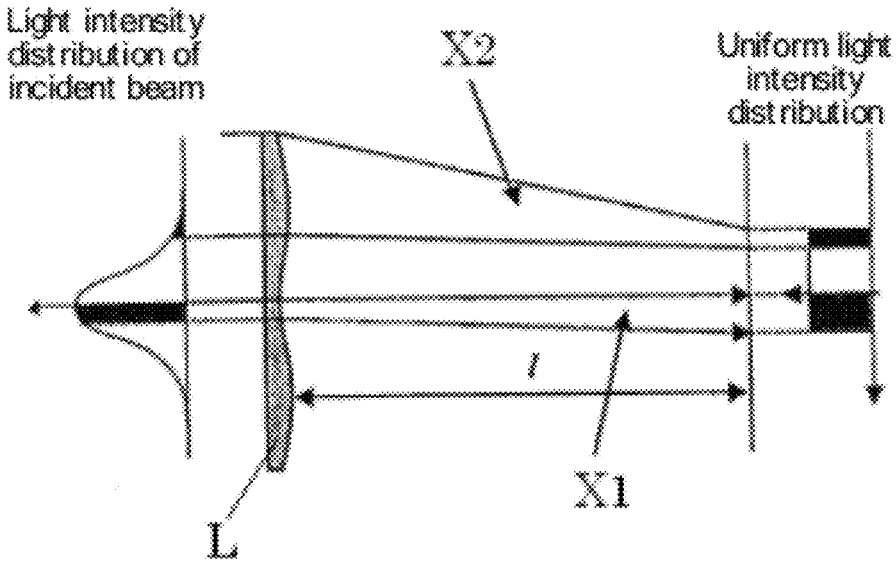
FIG. 4B is a schematic diagram illustrating another example of a light-irradiation intensity controlling unit in an image processing apparatus according to the present invention.

In addition, as illustrated in FIG. 4B, only an intensity conversion lens L may be disposed on an optical path of a laser beam emitted from the laser beam emitting unit. In this case, concerning an incident beam (laser beam) with a Gaussian intensity distribution, by diffusing the laser beam at a portion having a strong intensity (internal portion) as indicated by X1 in the figure, in contrast, by converging the light beam at a portion having a weak intensity (external portion) as indicated by X2, the light irradiation intensities can be converted so that the light irradiation intensity of a center portion in the light intensity distribution is equal to or lower than that of the peripheral portions (so as to have a flat top shape in FIG. 4B).

The following describes one example of a method of adjusting the light irradiation intensity using a combination of a fiber-coupled semiconductor laser and a lens as the light-irradiation-intensity-distribution-adjusting unit.

In a fiber-coupled semiconductor laser, since a laser beam is transmitted in an optical fiber while repeatedly reflecting, a light intensity distribution of a laser beam emitted from the fiber edge will be different from the Gauss distribution and will be a light intensity distribution corresponding to an intermediate distribution pattern between the Gaussian distribution and the flat top-shaped distribution pattern. As a condensing optical system, a combination unit of a plurality of convex lenses and/or concave lenses is attached to the fiber edge so that such a light intensity distribution is converted into the flat top-shaped distribution pattern.

EXAMPLES

Hereinafter, the present invention will be described in more detail with reference to Examples, which however shall not be construed as limiting the scope of the present invention.

<Production of Thermoreversible Recording Medium>

A thermally reversible recording medium capable of reversibly changing in color tone depending on a change in temperature was produced in the following manner.

—Support—

As a support, a white turbid polyester film of 125 μm in thickness (TETRON FILM U2L98W, produced by TEIJIN DUPONT FILMS JAPAN LTD.) was used.

—Formation First Oxygen Barrier Layer—

A urethane-based adhesive (produced by Toyo-Morton Ltd., TM-567) (5 parts by mass), isocyanate (produced by Toyo-Morton Ltd., CAT-RT-37) (0.5 parts by mass), and ethyl acetate (5 parts by mass) were mixed and substantially stirred to prepare an oxygen barrier layer coating liquid.

Next, the oxygen barrier layer coating liquid was applied onto a silica-deposited PET film (produced by Mitsubishi Plastics Inc., TECHBARRIER HX, oxygen permeability: 0.5 mL/m$^2$/day/MPa) using a wire bar, heated and dried at 80° C. for 1 minute. This silica-deposited PET film provided with the oxygen barrier layer was bonded on the support, and then heated at 50° C. for 24 hours, thereby forming a first oxygen barrier layer having a thickness of 12 μm.

—Formation of First Thermoreversible Recording Layer—

A reversible developer represented by the following Structural Formula (1) (5 parts by mass), a color-erasing accelerator represented by the following Structural Formula (2) (0.5 parts by mass), a color-erasing accelerator represented by the following Structural Formula (3) (0.5 parts by mass), a 50% by mass acrylpolyol solution (hydroxyl group value: 200 mgKOH/g) (10 parts by mass) and methylethylketone (80 parts by mass) were pulverized and dispersed in a ball mill until the average particle diameter became about 1 μm.

Structural Formula (1)

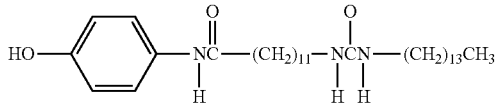

Structural Formula (2)

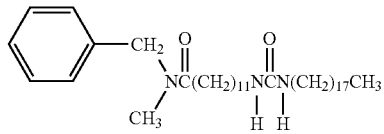

Structural Formula (3)

$C_{17}H_{35}CONHC_{18}H_{35}$

Next, in a dispersion liquid in which the reversible developer had been pulverized and dispersed, 2-anilino-3-methyl-6-dibutylaminofluoran (1 part by mass) as the leuco dye, and isocyanate (COLLONATE HL, produced by Nippon Polyurethane Industry Co., Ltd.) (5 parts by mass) were added, and the materials were substantially stirred to prepare a thermoreversible recording layer coating liquid.

The thus obtained thermoreversible recording layer coating liquid was applied onto the first oxygen barrier layer using a wire bar, dried at 100° C. for 2 minutes, and then cured at 60° C. for 24 hours, thereby forming a first thermoreversible recording layer of 6 μm in thickness.

—Formation of Photothermal Conversion Layer—

A 1% by mass solution of a phthalocyanine photothermal conversion material (produced by NIPPON SHOKUBAI CO., LTD.; IR-14, absorption peak wavelength: 824 nm) (4 parts by mass), a 50% by mass acrylpolyol solution (hydroxyl group value: 200 mgKOH/g) (10 parts by mass), methylethylketone (20 parts by mass) and isocyanate (COLLONATE HL, produced by Nippon Polyurethane Industry Co., Ltd.) (5 parts by mass) as a crosslinker were sufficiently stirred to prepare a photothermal conversion layer coating liquid. The thus obtained photothermal conversion layer coating liquids was applied onto the first thermoreversible recording layer using a wire bar, dried at 90° C. for 1 minute and then cured at 60° C. for 24 hours, thereby forming a photothermal conversion layer of 4 μm in thickness.

—Formation of Second Thermoreversible Recording Layer—

A thermoreversible recording layer composition having the same composition as used in the first thermoreversible recording layer was applied onto the photothermal conversion layer using a wire bar, dried at 100° C. for 2 minutes and then cured at 60° C. for 24 hours, thereby forming a second thermoreversible recording layer of 6 μm in thickness.

—Formation of Ultraviolet Absorbing Layer—

A 40% by mass solution of ultraviolet absorbing polymer (UV-G300, produced by NIPPON SHOKUBAI CO., LTD.) (10 parts by mass), isocyanate (COLLONATE HL, produced by Nippon Polyurethane Industry Co., Ltd.) (1.5 parts by mass) and methylethylketone (12 parts by mass) were mixed and substantially stirred to prepare an ultraviolet absorbing layer coating liquid.

Next, the ultraviolet absorbing layer coating liquid was applied onto the second thermoreversible recording layer using a wire bar, heated and dried at 90° C. for 1 minute and then heated at 60° C. for 24 hours, thereby forming an ultraviolet absorbing layer of 4 μm in thickness.

—Formation of Second Oxygen Barrier Layer—

A silica-deposited PET film provided with an oxygen barrier layer, similar to the first oxygen barrier layer, was bonded on the ultraviolet absorbing layer, and then heated at 50° C. for 24 hours, thereby forming a second oxygen barrier layer having a thickness of 12 μm.

—Formation of Back Layer—

In a ball mill, pentaerythritol hexaacrylate (KARAYAD DPHA, produced by Nippon Kayaku Co., Ltd.) (7.5 parts by mass), urethane acrylate oligomer (ART RESIN UN-3320HA, produced by Negami Chemical Industrial Co., Ltd.) (2.5 parts by mass), a needle-like conductive titanium oxide (FT-3000, produced by ISHIHARA INDUSTRY CO., LTD., major axis=5.15 μm, minor axis=0.27 μm, composition: titanium oxide coated with antimony-doped tin oxide) (2.5 parts by mass), a photopolymerization initiator (IRGACURE 184, produced by Chiba Geigy Japan Co., Ltd.) (0.5 parts by mass) and isopropyl alcohol (13 parts by mass) were substantially stirred to prepare a back layer coating liquid.

Next, over the opposite surface of the support from the surface on which the first thermoreversible recording layer and the like had been formed, the back layer coating liquid was applied using a wire bar, and the applied coating liquid was heated at 90° C. for 1 minute, dried and then crosslinked by means of an ultraviolet lamp of 80 W/cm to thereby form a back layer having a thickness of 4 μm. With the above-mentioned treatments, a thermoreversible recording layer was produced.

Production Example 2

Production of Thermoreversible Recording Medium

A thermoreversible recording medium of Production Example 2 was produced in the same manner as in Production Example 1, except that a first thermoreversible recording layer, a photothermal conversion layer and a second thermoreversible recording layer were produced according to the following procedures.

—Formation of Thermoreversible Recording Layer Containing Photothermal Conversion Material—

A reversible developer represented by the above Structural Formula (1) (5 parts by mass), a color-erasing accelerator represented by the above Structural Formula (2) (0.5 parts by mass), a color-erasing accelerator represented by the above Structural Formula (3) (0.5 parts by mass), a 50% by mass acrylpolyol solution (hydroxyl group value: 200 mgKOH/g) (8 parts by mass) and methylethylketone (80 parts by mass) were pulverized and dispersed in a ball mill until the average particle diameter became about 1 μm.

Next, in a dispersion liquid in which the reversible developer had been pulverized and dispersed, 2-anilino-3-methyl-6-dibutylaminofluoran (1 part by mass) as the leuco dye, isocyanate (COLLONATE HL, produced by Nippon Polyurethane Industry Co., Ltd.) (5 parts by mass), a 1.85% by mass dispersion liquid of $LaB_6$ (produced by Sumitomo Metal Mining Co., Ltd., KHF-7A) (1.2 parts by mass) and methylethylketone (12 parts by mass) were added, and the materials were substantially stirred to prepare a thermoreversible recording layer coating liquid.

The thus obtained thermoreversible recording layer coating liquid was applied onto the first oxygen barrier layer using a wire bar, dried at 100° C. for 2 minutes, and then cured at 60° C. for 24 hours, thereby forming a thermoreversible recording layer containing a photothermal conversion material and having a thickness of 12 μm.

Example 1

As a laser, a semiconductor laser, ES-6200-A manufactured by QPC Laser Inc. (center wavelength: 808 nm) was used, and controlled to emit one laser beam so that the output power was 27.3 W, the irradiation distance was 141 mm, the spot diameter was about 0.65 mm, the scanning speed was 2,000 mm/s, the irradiation energy was 21 mJ/mm$^2$, and the line width was 0.42 mm. Then, the laser beam was made to scan a region of the thermoreversible recording medium obtained in Production Example 1 to form a first line written with laser beam (indicated by E7 in FIG. 2) as a line written first.

Next, another laser beam was controlled so that the output power was 22.2 W, the irradiation distance was 141 mm, the spot diameter was about 0.65 mm, the scanning speed was 2,000 mm/s, the irradiation energy was 17.1 mJ/mm$^2$, and the width overlapped with the first written line was 0.22 mm (pitch: 0.20 mm), and the laser beam was made to scan the thermoreversible recording medium to form a second line written with laser beam, as an overwritten line (indicated by E8 in FIG. 2).

Further, a still another laser beam was controlled so that the output power was 22.2 W, the irradiation distance was 141 mm, the spot diameter was about 0.65 mm, the scanning speed was 2,000 mm/s, the irradiation energy was 17.1 mJ/mm$^2$, and the width overlapped with the second written line was 0.22 mm (pitch: 0.20 mm), and the laser beam was made to scan the thermoreversible recording medium to form a third line written with laser beam, as an overwritten line (indicated by E9 in FIG. 2).

With the above procedure, a bold line having a line width of 0.86 mm was recorded.

Note that in Example 1, X=0.22/0.42=0.52, Y=21/17.1=1.23, and −0.8X+Y=0.814.

Also, the formed bold line image was evaluated on whether or not it was formed with high fineness.

Next, twenty laser beams were controlled so that the output power was 29.2 W, the irradiation distance was 180 mm, the spot diameter was about 3 mm, the scanning speed was 1,000 mm/s, and these laser beams were irradiated to scan the thermoreversible recording medium so that the resulting pitch was 0.6 μm. As a result, the image could be completely erased.

Furthermore, image formation and image erasure were repeated 2,000 times under the above-mentioned conditions, and images could be recorded uniformly and erased uniformly.

The results of the image evaluation, image erasure time and image-recording/erasure repeat test were shown in Table 1.

<Measurement of Image Line Width>

The light width of the image was measured as follows. First, a gray scale (produced by Kodak Inc.) was captured with a scanner (manufactured by Canon Inc., CANOSCAN 4400) to obtain a digital gray-scale value, and a correlation between the digital gray-scale value and a density value of the image measured by a reflection densitometer (manufactured by Macbeth Corp., RD-914) was determined. Then, the digital gray-scale value obtained by capturing the recorded image with the scanner was converted into a density value, and the line width of the image was calculated from the number of set pixels (1,200 dpi) of the digital gray-scale value, using a width when the density value was 0.7 or higher, as a line width.

Example 2

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 18.8 W, the irradiation distance was 141 mm, the spot diameter was about 0.65 mm, the scanning speed was 2,000 mm/s, the irradiation energy was 14.5 mJ/mm$^2$, and the overlapped width was 0.27 mm (pitch: 0.15 mm), was used to scan the thermoreversible recording medium. As a result, the image could be completely erased.

Note that in Example 2, the line width of the formed bold line was 0.67 mm, X=0.27/0.42=0.64, Y=21/14.5=1.45, and −0.8X+Y=0.938.

The formed bold line image was evaluated on whether or not it was formed with high fineness.

Further, the image formation and image erasure were repeated 2,000 times under the above-mentioned conditions. As a result, images could be recorded uniformly and erased uniformly.

The results of the image evaluation, image erasure time and image-recording/erasure repeat test were shown in Table 1.

Example 3

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 18.8 W, the irradiation distance was 141 mm, the spot diameter was about 0.65 mm, the scanning speed was 2,000 mm/s, the irradiation energy was 14.5 mJ/mm$^2$, and the overlapped width was 0.32 mm (pitch: 0.10 mm), was used to scan the thermoreversible recording medium. As a result, the image could be completely erased.

Note that in Example 3, the line width of the formed bold line was 0.62 mm, X=0.32/0.42=0.76, Y=21/14.5=1.45, and −0.8X+Y=0.842.

The formed bold line image was evaluated on whether or not it was formed with high fineness.

Further, the image formation and image erasure were repeated 2,000 times under the above-mentioned conditions. As a result, images could be recorded uniformly and erased uniformly.

The results of the image evaluation, image erasure time and image-recording/erasure repeat test were shown in Table 1.

Example 4

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 25.6 W, the irradiation distance was 141 mm, the spot diameter was about 0.65 mm, the scanning speed was 2,000 mm/s, the irradiation energy was 19.7 mJ/mm$^2$, and the overlapped width was 0.17 mm (pitch: 0.25 mm), was used to scan the thermoreversible recording medium. As a result, the image could be completely erased.

Note that in Example 4, the line width of the formed bold line was 1.02 mm, X=0.17/0.42=0.40, Y=21/19.7=1.07, and −0.8X+Y=0.750.

The formed bold line image was evaluated on whether or not it was formed with high fineness.

Further, the image formation and image erasure were repeated 1,500 times under the above-mentioned conditions. As a result, images could be recorded uniformly and erased uniformly.

The results of the image evaluation, image erasure time and image-recording/erasure repeat test were shown in Table 1.

Comparative Example 1

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 27.3 W, the irradiation distance was 141 mm, the spot diameter was about 0.65 mm, the scanning speed was 2,000 mm/s, the irradiation energy was 21 mJ/mm$^2$, and the overlapped width was 0.22 mm (pitch: 0.20 mm), was used to scan the thermoreversible recording medium. As a result, the image could be completely erased.

Note that in Comparative Example 1, the line width of the formed bold line was 0.90 mm, X=0.22/0.42=0.52, Y=21/21=1.00, and −0.8X+Y=0.581.

The formed bold line image was evaluated on whether or not it was formed with high fineness.

Further, the image formation and image erasure were repeated under the above-mentioned conditions. As a result, images could be recorded uniformly and erased uniformly up to 500 times of the repeated cycles of image formation and image erasure, however, after 1,000 times of the repeated cycles, unerased portions of image were observed conspicuously, and it became impossible to uniformly erase the images.

The results of the image evaluation, image erasure time and image-recording/erasure repeat test were shown in Table 2.

Comparative Example 2

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 27.3 W, the irradiation distance was 141 mm, the spot diameter was about 0.65 mm, the scanning speed was 2,000 mm/s, the irradiation energy was 21 mJ/mm$^2$, and the overlapped width was 0.10 mm (pitch: 0.32 mm), was used to scan the thermoreversible recording medium. As a result, the image could be completely erased.

Note that in Comparative Example 2, the line width of the formed bold line was 1.18 mm, X=0.10/0.42=0.24, Y=21/21=1.00, and −0.8X+Y=0.810.

The formed bold line image was evaluated on whether or not it was formed with high fineness.

Further, the image formation and image erasure were repeated under the above-mentioned conditions. As a result, images could be recorded uniformly and erased uniformly up to 2,000 times of the repeated cycles of image formation and image erasure.

The results of the image evaluation, image erasure time and image-recording/erasure repeat test were shown in Table 2.

In Comparative Example 2, print dropouts as illustrated in FIG. 9 occurred.

Comparative Example 3

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 27.3 W, the irradiation distance was 141 mm, the spot diameter was about 0.65 mm, the scanning speed was 2,000 mm/s, the irradiation energy was 21 mJ/mm$^2$, and the overlapped width was 0.27 mm (pitch: 0.15 mm), was used to scan the thermoreversible recording medium. As a result, the image could be completely erased.

Note that in Comparative Example 3, the line width of the formed bold line was 0.75 mm, X=0.27/0.42=0.64, Y=21/21=1.00, and −0.8X+Y=0.486.

The formed bold line image was evaluated on whether or not it was formed with high fineness.

Further, the image formation and image erasure were repeated under the above-mentioned conditions. As a result, images could be recorded uniformly and erased uniformly up to 100 times of the repeated cycles of image formation and image erasure, however, after 500 times of the repeated cycles, unerased portions of image were observed conspicuously, and it became impossible to uniformly erase the images.

The results of the image evaluation, image erasure time and image-recording/erasure repeat test were shown in Table 2.

Reference Example 4

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 17 W, the irradiation distance was 141 mm, the spot diameter was about 0.65 mm, the scanning speed was 2,000 mm/s, the irradiation energy was 13.1 mJ/mm$^2$, and the overlapped width was 0.22 mm (pitch: 0.20 mm), was used to scan the thermoreversible recording medium. As a result, the image could be completely erased.

Note that in Reference Example 4, the line width of the formed bold line was 0.82 mm, X=0.22/0.42=0.52, Y=21/13.1=1.60, and −0.8X+Y=1.184.

The formed bold line image was evaluated on whether or not it was formed with high fineness.

Further, the image formation and image erasure were repeated under the above-mentioned conditions. As a result, images could be recorded uniformly and erased uniformly up to 2,000 times of the repeated cycles of image formation and image erasure. In Reference Example 4, image feathering occurred.

The results of the image evaluation, image erasure time and image-recording/erasure repeat test were shown in Table 2.

Comparative Example 5

Image formation and image erasure were carried out in the same manner as in Example 1, except that in the formation of the second and third laser-beam-written lines as overwritten lines, instead of scanning the thermoreversible recording medium with the laser beam controlled so that the output power was 22.2 W, the irradiation distance was 141 mm, the spot diameter was about 0.65 mm, the scanning speed was 2,000 mm/s, the irradiation energy was 17.1 mJ/mm$^2$, and the overlapped width was 0.22 mm (pitch: 0.20 mm), a laser beam which was controlled so that the output power was 27.3 W, the irradiation distance was 141 mm, the spot diameter was about 0.65 mm, the scanning speed was 2,000 mm/s, the irradiation energy was 21 mJ/mm$^2$, and the overlapped width was 0.32 mm (pitch: 0.10 mm), was used to scan the thermoreversible recording medium. As a result, the image could be completely erased.

Note that in Comparative Example 5, the line width of the formed bold line was 0.66 mm, X=0.32/0.42=0.76, Y=21/21=1.00, and −0.8X+Y=0.390.

The formed bold line image was evaluated on whether or not it was formed with high fineness.

Further, the image formation and image erasure were repeated under the above-mentioned conditions. As a result, images could be recorded uniformly and erased uniformly up to 10 times of the repeated cycles of image formation and image erasure, however, after 100 times of the repeated cycles, unerased portions of image were observed conspicuously, and it became impossible to uniformly erase the images.

The results of the image evaluation, image erasure time and image-recording/erasure repeat test were shown in Table 2.

Example 5

As a laser, a semiconductor laser, BMU25-975-01-R (center wavelength: 976 nm) manufactured by Oclaro Inc. was used, and controlled to emit one laser beam so that the output power was 14.4 W, the irradiation distance was 175 mm, the spot diameter was about 0.48 mm, the scanning speed was 2,000 mm/s, the irradiation energy was 15 mJ/mm$^2$, and the line width was 0.28 mm. Then, the laser beam was made to scan a region of the thermoreversible recording medium obtained in Production Example 2 to form a first line written with laser beam (indicated by E7 in FIG. 2) as a line written first.

Next, another laser beam was controlled so that the output power was 12.3 W, the irradiation distance was 175 mm, the spot diameter was about 0.48 mm, the scanning speed was 2,000 mm/s, the irradiation energy was 12.9 mJ/mm$^2$, and the width overlapped with the first written line was 0.18 mm (pitch: 0.10 mm), and the laser beam was made to scan the thermoreversible recording medium to form a second line written with laser beam, as an overwritten line (indicated by E8 in FIG. 2).

Further, a still another laser beam was controlled so that the output power was 12.3 W, the irradiation distance was 175 mm, the spot diameter was about 0.48 mm, the scanning speed was 2,000 mm/s, the irradiation energy was 12.9 mJ/mm$^2$, and the width overlapped with the second written line was 0.18 mm (pitch: 0.10 mm), and the laser beam was made to scan the thermoreversible recording medium to form a third line written with laser beam, as an overwritten line (indicated by E9 in FIG. 2).

With the above procedure, a bold line having a line width of 0.43 mm was recorded.

Note that in Example 5, X=0.18/0.28=0.64, Y=15/12.9=1.16, and −0.8X+Y=0.648.

Also, the formed bold line image was evaluated on whether or not it was formed with high fineness.

Next, twenty laser beams were controlled so that the output power was 20 W, the irradiation distance was 130 mm, the spot diameter was about 3 mm, the scanning speed was 650 mm/s, and these laser beams were irradiated to scan the thermoreversible recording medium so that the resulting pitch was 0.6 μm. As a result, the image could be completely erased.

Furthermore, image formation and image erasure were repeated 2,000 times under the above-mentioned conditions, and images could be recorded uniformly and erased uniformly.

Example 6

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 11.3 W, the irradiation distance was 175 mm, the spot diameter was about 0.48 mm, the scanning speed was 2,000 mm/s, the irradiation energy was 11.7 mJ/mm$^2$, and the overlapped width was 0.23 mm (pitch: 0.05 mm), was used to scan the thermoreversible recording medium. As a result, the image could be completely erased.

Note that in Example 6, the line width of the formed bold line was 0.32 mm, X=0.23/0.28=0.82, Y=15/11.7=1.28, and −0.8X+Y=0.624.

The formed bold line image was evaluated on whether or not it was formed with high fineness.

Further, the image formation and image erasure were repeated 2,000 times under the above-mentioned conditions. As a result, images could be recorded uniformly and erased uniformly.

The results of the image evaluation, image erasure time and image-recording/erasure repeat test were shown in Table 3.

Example 7

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 13.0 W, the irradiation distance was 175 mm, the spot diameter was about 0.48 mm, the scanning speed was 2,000 mm/s, the irradiation energy was 13.9 mJ/mm$^2$, and the overlapped width was 0.13 mm (pitch: 0.15 mm), was used to scan the thermoreversible recording medium. As a result, the image could be completely erased.

Note that in Example 7, the line width of the formed bold line was 0.58 mm, X=0.13/0.28=0.46, Y=15/13.9=1.08, and −0.8X+Y=0.712.

The formed bold line image was evaluated on whether or not it was formed with high fineness.

Further, the image formation and image erasure were repeated 2,000 times under the above-mentioned conditions. As a result, images could be recorded uniformly and erased uniformly.

The results of the image evaluation, image erasure time and image-recording/erasure repeat test were shown in Table 3.

Comparative Example 6

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 14.4 W, the irradiation distance was 175 mm, the spot diameter was about 0.48 mm, the scanning speed was 2,000 mm/s, the irradiation energy was 15 mJ/mm$^2$, and the overlapped width was 0.22 mm (pitch: 0.10 mm), was used to scan the thermoreversible recording medium. As a result, the image could be completely erased.

Note that in Comparative Example 6, the line width of the formed bold line was 0.48 mm, X=0.18/0.28=0.643, Y=15/15=1.00, and −0.8X+Y=0.488.

The formed bold line image was evaluated on whether or not it was formed with high fineness.

Further, the image formation and image erasure were repeated under the above-mentioned conditions. As a result, images could be recorded uniformly and erased uniformly up to 500 times of the repeated cycles of image formation and image erasure, however, after 1,000 times of the repeated cycles, unerased portions of image were observed conspicuously, and it became impossible to uniformly erase the images.

The results of the image evaluation, image erasure time and image-recording/erasure repeat test were shown in Table 4.

Comparative Example 7

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 14.4 W, the irradiation distance was 175 mm, the spot diameter was about 0.48 mm, the scanning speed was 2,000 mm/s, the irradiation energy was 15 mJ/mm$^2$, and the overlapped width was 0.03 mm (pitch: 0.25 mm), was used to scan the thermoreversible recording medium. As a result, the image could be completely erased.

Note that in Comparative Example 7, the line width of the formed bold line was 0.78 mm, X=0.03/0.28=0.107, Y=15/15=1.00, and −0.8X+Y=0.914.

The formed bold line image was evaluated on whether or not it was formed with high fineness.

Further, the image formation and image erasure were repeated under the above-mentioned conditions. As a result, images could be recorded uniformly and erased uniformly up to 2,000 times of the repeated cycles.

The results of the image evaluation, image erasure time and image-recording/erasure repeat test were shown in Table 4.

In Comparative Example 7, print dropout as illustrated in FIG. 9 occurred.

Comparative Example 8

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 14.4 W, the irradiation distance was 175 mm, the spot diameter was about 0.48 mm, the scanning speed was 2,000 mm/s, the irradiation energy was 15 mJ/mm$^2$, and the overlapped width was 0.23 mm (pitch: 0.05 mm), was used to scan the thermoreversible recording medium. As a result, the image could be completely erased.

Note that in Comparative Example 8, the line width of the formed bold line was 0.38 mm, X=0.23/0.28=0.821, Y=15/15=1.00, and −0.8X+Y=0.343.

The formed bold line image was evaluated on whether or not it was formed with high fineness.

Further, the image formation and image erasure were repeated under the above-mentioned conditions. As a result, images could be recorded uniformly and erased uniformly up to 100 times of the repeated cycles of image formation and image erasure, however, after 500 times of the repeated cycles, unerased portions of image were observed conspicuously, and it became impossible to uniformly erase the images.

The results of the image evaluation, image erasure time and image-recording/erasure repeat test were shown in Table 4.

Reference Example 9

Image formation and image erasure were carried out in the same manner as in Example 5, except that in the formation of the second and third laser-beam-written lines as overwritten lines, instead of scanning the thermoreversible recording medium with the laser beam controlled so that the output power was 12.3 W, the irradiation distance was 175 mm, the spot diameter was about 0.48 mm, the scanning speed was 2,000 mm/s, the irradiation energy was 12.9 mJ/mm$^2$, and the overlapped width was 0.18 mm (pitch: 0.10 mm), a laser beam which was controlled so that the output power was 9 W, the irradiation distance was 175 mm, the spot diameter was about 0.48 mm, the scanning speed was 2,000 mm/s, the irradiation energy was 9.4 mJ/mm$^2$, and the overlapped width was 0.18 mm (pitch: 0.10 mm), was used to scan the thermoreversible recording medium. As a result, the image could be completely erased.

Note that in Reference Example 9, the line width of the formed bold line was 0.48 mm, X=0.18/0.28=0.643, Y=15/9.4=1.60, and −0.8X+Y=1.086.

The formed bold line image was evaluated on whether or not it was formed with high fineness.

Further, the image formation and image erasure were repeated under the above-mentioned conditions. As a result, images could be recorded uniformly and erased uniformly up to 2,000 times of the repeated cycles. In Reference Example 9, image feathering occurred.

The results of the image evaluation, image erasure time and image-recording/erasure repeat test were shown in Table 4.

TABLE 1

| | Pitch (mm) | Overlapped width (mm) | X | Y | −0.8X + Y | Evaluation of image | Repeat test: No. of repeated times | Repeat test: Evaluation of image |
|---|---|---|---|---|---|---|---|---|
| Ex. 1 | 0.20 | 0.22 | 0.52 | 1.23 | 0.814 | A | 2,000 | A |
| Ex. 2 | 0.15 | 0.27 | 0.64 | 1.45 | 0.938 | A | 2,000 | A |
| Ex. 3 | 0.10 | 0.32 | 0.76 | 1.45 | 0.842 | A | 2,000 | A |
| Ex. 4 | 0.25 | 0.17 | 0.40 | 1.07 | 0.750 | A | 1,500 | B |

TABLE 2

| | Pitch (mm) | Overlapped width (mm) | X | Y | −0.8X + Y | Evaluation of image | Repeat test: No. of repeated times | Repeat test: Evaluation of image |
|---|---|---|---|---|---|---|---|---|
| Comp. Ex. 1 | 0.20 | 0.22 | 0.52 | 1.00 | 0.581 | A | 500 | C |
| Comp. Ex. 2 | 0.32 | 0.10 | 0.24 | 1.00 | 0.810 | B | 2,000 | A |
| Comp. Ex. 3 | 0.15 | 0.27 | 0.64 | 1.00 | 0.486 | A | 100 | C |
| Ref. Ex. 4 | 0.20 | 0.22 | 0.52 | 1.60 | 1.184 | B | 2,000 | A |
| Comp. Ex. 5 | 0.10 | 0.32 | 0.76 | 1.00 | 0.390 | A | 10 | D |

TABLE 3

| | Pitch (mm) | Overlapped width (mm) | X | Y | −0.8X + Y | Evaluation of image | Repeat test: No. of repeated times | Repeat test: Evaluation of image |
|---|---|---|---|---|---|---|---|---|
| Ex. 5 | 0.10 | 0.18 | 0.64 | 1.16 | 0.648 | A | 2,000 | A |
| Ex. 6 | 0.05 | 0.23 | 0.82 | 1.28 | 0.624 | A | 2,000 | A |
| Ex. 7 | 0.15 | 0.13 | 0.46 | 1.08 | 0.712 | A | 2,000 | A |

TABLE 4

| | Pitch (mm) | Overlapped width (mm) | X | Y | −0.8X + Y | Evaluation of image | Repeat test: No. of repeated times | Repeat test: Evaluation of image |
|---|---|---|---|---|---|---|---|---|
| Comp. Ex. 6 | 0.10 | 0.18 | 0.64 | 1.00 | 0.488 | A | 1,000 | C |
| Comp. Ex. 7 | 0.25 | 0.03 | 0.107 | 1.00 | 0.914 | B | 2,000 | B |
| Comp. Ex. 8 | 0.05 | 0.23 | 0.82 | 1.00 | 0.343 | A | 500 | C |
| Ref. Ex. 9 | 0.10 | 0.18 | 0.64 | 1.60 | 1.086 | B | 2,000 | B |

The criteria on "Evaluation of image" and on "Repeat test" shown in Tables 1 to 4 are as follows:

[Evaluation of Image]

A: The resulting images were formed with a uniform image density, and no image-dropout was observed.

B: Image dropout or image feathering was observed in the resulting images.

[Evaluation Criteria on Repeat Test]

A: Even when image formation and image erasure were repeated 2,000 times, images could be recorded and erased uniformly.

B: Even when image formation and image erasure were repeated ranging from 1,001 times to 1,999 times, images could be recorded and erased uniformly.

C: Even when image formation and image erasure were repeated ranging from 501 times to 1000 times, images could be recorded and erased uniformly.

D: It became difficult to record and erase images uniformly before the number of repeated cycles of image formation and image erasure reached 500 times.

Hereinabove, the present invention have been described in detail with reference to preferred embodiments (Examples), which however shall not be construed as limiting the scope of the present invention. On the contrary, the present invention is intended to cover various modifications and equivalent arrangements included within the spirit and scope of the present invention described in the appended claims.

Since the image processing method of the present invention enables precisely forming an image of lines having a predetermined line width on a thermoreversible recording medium and ensuring repetitive durability, the method can be widely used in a variety of displays for media on which read codes of information (e.g., bar code, QR code, bold characters) are formed, for example, In-Out tickets, stickers for frozen meal containers, industrial products, various medical containers, and large screens and various displays for logistical management application use and production process management application use, and can be particularly suitably used in logistical/physical distribution systems and process management systems in factories.

What is claimed is:

1. An image processing method comprising:

recording an image by irradiating a recording medium with laser beams which are arrayed in parallel at predetermined intervals to heat the recording medium, so that the image is composed of a plurality of lines written with the laser beams on the recording medium, wherein in the image recording, the plurality of lines written with the laser beams include a line written first and an overwritten line, a part of which is overlapped with the line written first; and the irradiation energy for the overwritten line is smaller than the irradiation energy for the line written first, and wherein a ratio X of an overlapped width of the overwritten line relative to a line width of the line written first, and a ratio Y of the irradiation energy for the line written first relative to the irradiation energy applied to the overwritten line satisfy the following Expression (1):

$$0.6 \leqq -0.8X+Y \leqq 1.0 \quad \text{Expression (1).}$$

2. The image processing method according to claim 1, wherein the ratio X satisfies the following Expression (2):

$$0.7 \leqq -0.8X+Y \leqq 1.0 \quad \text{Expression (2)}$$

3. The image processing method according to claim 2, wherein the ratio X satisfies the following Expression (3):

$$0.4 \leqq X < 1 \quad \text{Expression (3).}$$

4. The image processing method according to claim 1, wherein the ratio X satisfies the following Expression (4):

$$0.6 \leqq X < 1 \quad \text{Expression (4).}$$

5. The image processing method according to claim 1, wherein the irradiation energy for the lines written with the laser beams is controlled by adjusting irradiation power of the laser beam.

6. The image processing method according to claim 1, wherein the irradiation energy for the lines written with the laser beams is controlled by adjusting the scanning speed of the laser beam.

7. The image processing method according to claim 1, wherein in a light intensity distribution on a cross-sectional plane along a direction substantially orthogonal to a traveling direction of the laser beams irradiated in the image recording, the intensity of a light beam applied onto a central portion is equal to or lower than the intensity of a light beam applied onto peripheral portions.

8. The image processing method according to claim 1, wherein the recording medium is a thermoreversible recording medium, the thermoreversible recording medium comprises a support and at least a first thermoreversible recording layer, a photothermal conversion layer containing a photothermal conversion material which absorbs light having a specific wavelength and converts the light into heat, and a second thermoreversible recording layer in this order over the support; and both the first thermoreversible recording layer and the second thermoreversible recording layer reversibly change in color tone depending on a change in temperature.

9. The image processing method according to claim 8, wherein the first thermoreversible recording layer and the second thermoreversible recording layer individually contains a leuco dye and a reversible developer.

10. The image processing method according to claim 8, wherein the photothermal conversion material is a material having an absorption peak in the near-infrared spectral region.

11. The image processing method according to claim 8, wherein the photothermal conversion material is one of a metal boride and a metal oxide.

12. The image processing method according to claim 8, wherein the photothermal conversion material is a phthalocyanine-based compound.

13. The image processing method according to claim 1, wherein the recording medium is a thermoreversible recording medium, the thermoreversible recording medium comprises a support and at least a thermoreversible recording layer containing a photothermal conversion material, which absorbs light having a specific wavelength and converts the light into heat, a leuco dye and a reversible developer, over the support; and the thermoreversible recording layer reversibly changes in color tone depending on a change in temperature.

14. An image processing apparatus comprising:

a laser beam emitting unit, an optical scanning unit disposed on a laser-beam emitting surface of the laser beam emitting unit, a light-irradiation-intensity-distribution-adjusting unit configured to alter a light irradiation intensity distribution of a laser beam, and an fθ lens which converges laser beams, wherein the image processing apparatus is used for an image processing method which comprises: recording an image by irradiating a recording medium with laser beams which are arrayed in parallel at predetermined intervals to heat the recording medium, so that the image is composed of a plurality of lines written with the laser beams on the recording medium, and wherein in the image recording, the plurality of lines written with the laser beams include a line written first and an overwritten line, a part of which is overlapped with the line written first; and the irradiation energy for the overwritten line is smaller than the irradiation energy for the line written first, and wherein a ratio X of an overlapped width of the overwritten line relative to a line width of the line written first, and a ratio Y of the irradiation energy for the line written first relative to the irradiation energy applied to the overwritten line satisfy the following Expression (1):

$$0.6 \leqq -0.8X+Y \leqq 1.0 \quad \text{Expression (1).}$$

15. The image processing apparatus according to claim 14, wherein the light-irradiation-intensity-distribution-adjusting unit is at least one selected from the group consisting of a lens, a filter, a mask, a mirror, and a fiber coupling.

* * * * *